United States Patent [19]

Fukagai et al.

[11] Patent Number: 4,863,822

[45] Date of Patent: Sep. 5, 1989

[54] ELECTROPHOTOGRAPHIC PHOTOCONDUCTOR COMPRISING CHARGE GENERATING AND TRANSPORT LAYERS CONTAINING ADJUVANTS

[75] Inventors: Toshio Fukagai; Kiyoshi Taniguchi, both of Numazu; Katsuichi Ohta, Mishima; Kayoko Yokoyama; Minoru Umeda, both of Numazu, all of Japan

[73] Assignee: Ricoh Company Ltd., Tokyo, Japan

[21] Appl. No.: 166,001

[22] Filed: Mar. 9, 1988

[30] Foreign Application Priority Data

| | | | |
|---|---|---|---|
| Mar. 9, 1987 | [JP] | Japan | 62-054806 |
| Mar. 9, 1987 | [JP] | Japan | 62-054810 |
| Mar. 9, 1987 | [JP] | Japan | 62-054811 |
| Apr. 30, 1987 | [JP] | Japan | 62-108641 |
| Apr. 30, 1987 | [JP] | Japan | 62-108642 |
| Apr. 30, 1987 | [JP] | Japan | 62-108645 |
| Apr. 30, 1987 | [JP] | Japan | 62-108648 |
| Apr. 30, 1987 | [JP] | Japan | 62-108649 |

[51] Int. Cl.[4] ..... G03G 5/05

[52] U.S. Cl. ..... 430/58; 430/96

[58] Field of Search ..... 430/57, 58, 59, 96

[56] References Cited

U.S. PATENT DOCUMENTS

| | | | |
|---|---|---|---|
| 3,972,717 | 8/1976 | Wiedemann | 430/65 |
| 4,078,925 | 3/1978 | Horgan | 430/58 |
| 4,365,014 | 12/1982 | Sakai | 430/59 |
| 4,390,609 | 6/1983 | Wiedemann | 430/58 |

*Primary Examiner*—J. David Welsh

*Attorney, Agent, or Firm*—Oblon, Spivak, McClelland, Maier & Neustadt

[57] ABSTRACT

An electrophotographic photoconductor is disclosed, which comprises an electroconductive support and a photoconductive layer comprising (i) a charge generation layer and (ii) a charge transport layer formed on the support, in which the charge generation layer comprises a charge generating material and one component selected from the group consisting of an aliphatic alcohol and a crown ether, or the charge transport layer comprises a charge transporting material and one component selected from the group consisting of an aliphatic alcohol, a polyalkylene glycol, a polyalkylene glycol ester, a polyalkylene glycol ether, and a crown ether.

31 Claims, 1 Drawing Sheet

ELECTROPHOTOGRAPHIC PHOTOCONDUCTOR COMPRISING CHARGE GENERATING AND TRANSPORT LAYERS CONTAINING ADJUVANTS

BACKGROUND OF THE INVENTION

The present invention relates to an electrophotographic photoconductor comprising an electroconductive support and a photoconductive layer comprising (i) a charge generation layer and (ii) a charge transport layer formed on the support, and more particularly to an electrophotographic photoconductor in which the charge generation layer comprises a charge generating material and one component selected from the group consisting of an aliphatic alcohol and a crown ether, or the charge transport layer comprises a charge transporting material and one component selected from the group consisting of an aliphatic alcohol, a polyalkylene glycol, a polyalkylene glycol ester, a polyalkylene glycol ether and a crown ether.

Conventionally, electrophotographic photoconductors comprising a charge generation layer which contains a variety of resins as well as charge generating materials are employed. As such resins, polyvinyl butyral (Japanese Laid-Open patent application No. 58-105154), cellulose esters of fatty acids (Japanese Laid-Open patent application No. 58-166353), an acrylic resin having a glass transition temperature (Tg) of 70° C. or less, and an oxidation number of 10 to 40 (Japanese Laid-Open patent application No. 58-192040), a mixture of a resin having a glass transition temperature (Tg) of 70° C. or less and a resin having a glass transition temperature (Tg) of 75° C. or more (Japanese Laid-Open patent application No. 58-193549), a composition of a charge generating material, a resin and a solvent, to which another composition of a resin having a small compatibility to the first mentioned resin, and a solvent, is added and redispersed (Japanese Laid-Open patent application No. 56-12646), polyvinyl pyrrolidone (Japanese Laid-Open patent application No. 56-113140), and polyvinyl formal resin (Japanese Laid-Open patent application No. 61-235844) are employed.

However such conventional photoconductors have the shortcoming that the photosensitivity and the chargeability related to the pre-exposure fatigue of the photoconductors vary, depending upon the mixing ratio of a charge generating material and a resin binder.

In other words, when the weight ratio of a resin binder to a charge generating material is decreased, a higher photosensitivity can be obtained, but the chargeability is considerably decreased due to the pre-exposure fatigue. In contrast to this, when the weight ratio of a resin binder to a charge generating material is increased, the tendency for loss of the chargeability can be suppressed, but the problem occurs that the photosensitivity is significantly reduced.

The conventional photoconductors have another shortcoming that the surface potential considerably deteriorates during the repetition of the cycle of charging and exposure.

Furthermore a variety of organic electrophotographic photoconductors are proposed, for instance, a photoconductive resin type photoconductor typified by polyvinyl carbazole (PVK), a charge transport complex type typified by PVK-TNF (2,4,7-trinitro-fluorenone), a pigment dispersion type typified by a phthalocyanine-binder, and a function-separated type in which a charge generating material and a charge transporting material are combined. Among them, the last type especially attracts attention.

When a high-photosensitive photoconductor of such a function-separated type is applied to the Carlson process, it has the shortcoming that it exhibits a low chargeability and a poor electric charge retention (sharp dark decay). Furthermore, the chargeability and electric charge retention properties are drastically degraded in the course of repeated and continuous use, which cause uneven image density and fogging. Furthermore, the deposition of toner particles on the background occurs when reverse development is performed.

In general, the high-photosensitive photoconductors show the reduction in the chargeability due to the pre-exposure fatigue. Such fatigue is mainly caused by the light-absorbed charge generating materials. Therefore it is considered that the longer the period in which the electric charges generated by light absorption remain in a movable state in the photoconductor and the greater the number of the generated electric charges, the greater the reduction in the chargeability caused by the pre-exposure fatigue of the photoconductor. Even if the photoconductor is electrically charged in a state where the electric charges generated by light-absorption remain therein, the surface potential is not elevated until the residual electric charge is dissipated. This is because the electric charges at the surface of the photoconductor are neutralized by the transport of the residual carriers in the photoconductor. Thus, the rise of surface potential is delayed in such a manner as to correspond to the pre-exposure fatigue, and accordingly the apparent surface potential is lowered.

In order to solve the above-mentioned shortcomings, intermediate layers made of cellulose nitrate resins are disclosed in Japanese Laid-Open patent application Nos. 47-6341, 48-3544 and 48-12034; intermediate layers made of nylon resins in Japanese Laid-Open patent application Nos. 48-47344, 52-25638, 58-30757, 58-63945, 58-95351, 58-98739 and 60-66258; intermediate layers made of maleic acid resins in Japanese Laid-Open patent application Nos. 49-69332 and 52-10138; and an intermediate layer of polyvinyl alcohol resin in Japanese Laid-Open patent application No. 58-105155. Also, in order to control the electric resistivity of intermediate layer, intermediate layers which contain various electroconductive additives are proposed, for instance, an intermediate layer made of setting-resins to which carbon or a chalcogen material is added as disclosed in Japanese Laid-Open patent application No. 51-65942, an intermediate layer made of a polymer thermally polymerized by use of an isocyanate setting-agent to which a quaternary ammonium salt is added as disclosed in Japanese Laid-Open patent application No. 52-82238, an intermediate layer made of a resin to which a resistivity controlling agent is added as disclosed in Japanese Laid-Open patent application No. 55-1180451, an intermediate layer made of a resin to which aluminum oxide or tin oxide i dispersed as disclosed in Japanese Laid-Open patent application No. 58-58556, an intermediate layer made of a resin in which an organometallic compound is added as disclosed in Japanese Laid-Open patent application No. 58-93062, intermediate layers made of a resin in which electroconductive particles are dispersed as disclosed in Japanese Laid-Open patent application Nos. 58-93063, 60-97363 and 60-111255, and intermediate layers made of resins in which finely-divided particles of $TiO_2$ and $SnO_2$ are dispersed as disclosed in Japanese Laid-Open patent application Nos. 59-84257, 59-93453 and 60-32054.

From the viewpoint of controlling the electric charge transport instead of the electric resistivity, intermediate layers made of resins which contain an electron-acceptor organic compound serving as a negative charge transport material are disclosed. Examples of such intermediate layers are a photoconductive intermediate layer made of an organic polymer to which polycyclic aromatic nitro compound is added as disclosed in Japanese Laid-Open patent application No. 53-89433, and intermediate layers made of resins which contain an electron-acceptor organic material as disclosed in Japanese Laid-Open patent application Nos. 54-4134, 59-160147 and 59-170846.

In spite of employment of the above-mentioned intermediate layers, the reduction in the chargeability caused by the repeated and continuous use of the photoconductors, in particular, the delay in the rise of the surface potential thereof, is not sufficiently improved.

SUMMARY OF THE INVENTION

It is therefore an object of the present invention to provide an improved electrophotographic photoconductor, from which the above-mentioned conventional shortcomings are eliminated. More specifically, it is an object of the present invention to provide an electrophotographic photoconductor in which the reduction in the chargeability which may be caused by the pre-exposure fatigue is minimized, and the retention of the charged potential is maximized even though the cycle of charging and exposure is repeated for an extended period of time.

The above object of the present invention is attained by an electrophotographic photoconductor comprising an electroconductive support and a photoconductive layer comprising (i) a charge generation layer and (ii) a charge transport layer formed on the support, in which the charge generation layer comprises a charge generating material and at least one component selected from the group consisting of an aliphatic alcohol and a crown ether, or the charge transport layer comprises a charge transporting material and at least one component selected from the group consisting of an aliphatic alcohol, a polyalkylene glycol, a polyalkylene glycol ester, a polyalkylene glycol ether, and a crown ether.

In the present invention, when at least one component selected from the group consisting of an aliphatic alcohol and a crown ether is contained in the charge generation layer, it is considered that an aliphatic alcohol or a crown ether is chemically adsorbed by a charge generating material to constitute a recombination center of the electric charges generated by light-absorption, so that the electric charges generated by the pre-exposure fatigue are readily recombined to be dissipated, whereby the reduction in the charged potential of the photoconductor is minimized.

The above-mentioned effect on the pre-exposure fatigue is also observed during in practical use when the cycle of charging and exposure is repeated.

DETAILED DESCRIPTION OF THE PREFERRED EMBODIMENTS

Figure 1:
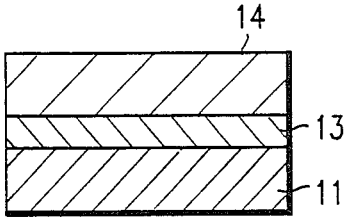
FIG. 1 is a schematic cross-sectional view of an embodiment of a double-layer type electrophotographic photoconductor according to the present invention.

A schematic cross-section view of a first embodiment of a double-layer type electrophotographic photoconductor according to the present invention is shown in FIG. 1. In this embodiment, a charge generation layer 13 and a charge transport layer 14 are successively overlaid on an electroconductive support 11.

Figure 2:
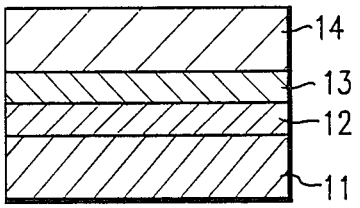
FIG. 2 is a schematic cross-sectional view of another embodiment of a double-layer type electrophotographic photoconductor according to the present invention.

A schematic cross-sectional view of a second embodiment of a double-layer type electrophotographic photoconductor according to the present invention is shown in FIG. 2. In this embodiment, an intermediate layer 12 is further interposed between an electroconductive support 11 and a charge generation layer 13 in the photoconductor as shown in FIG. 1.

Figure 3:
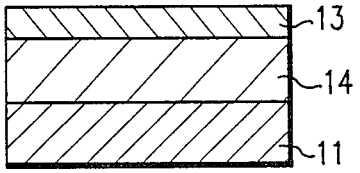
FIG. 3 is a schematic cross-sectional view of a further embodiment of a double-layer type electrophotographic photoconductor according to the present invention.

A schematic cross-sectional view of a third embodiment of a double-layer type electrophotographic photoconductor according to the present invention is shown in FIG. 3. In this embodiment, a charge transport layer 14 and a charge generation layer 13 are successively overlaid on an electroconductive support 11.

Figure 4:
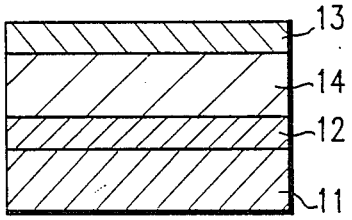
FIG. 4 is a schematic cross-sectional view of still another embodiment of a double-layer type electrophotographic photoconductor according to the present invention.

A schematic cross-sectional view of a fourth embodiment of a double-layer type electrophotographic photoconductor according to the present invention is shown in FIG. 4. In this embodiment, an intermediate layer 12 is further interposed between an electroconductive support 11 and a charge transport layer 14 in the photoconductor as shown in FIG. 3.

In the photoconductors as shown in FIG. 2 and FIG. 4, when the intermediate layer 12 is provided for promoting the adhesiveness between the charge generation layer 13 (or charge transport layer 14) and the electroconductive support 11, the intermediate layer 12 is made of a resin having excellent adhesiveness such as polyamide, polyester, a vinylchloride-vinyl acetate copolymer, and polyvinyl butyral; while when the intermediate layer 12 is provided for preventing interference in a photoconductor for use in a laser printer, a light-scattering layer or a light-absorbing layer is employed.

In the present invention, the electroconductive support 11 serves to provide a substrate of the photoconductor with electric charges having a polarity opposite to that of the charges applied to the surface of the photoconductor. It is preferable that the support have an electrical resistivity of $10^{10}$ Ωcm or less and further to withstand the conditions for the formation of a charge generation layer, a charge transport layer and an intermediate layer thereon. As such a support, there can be employed electroconductive metals or alloys such as Al, Ni, Cr, Zn, and stainless steel in any conventional forms; and electroconductive composite materials comprising (i) an inorganic insulating material such as glass and ceramics, or an organic insulating material such as polyester, polyimide, phenol resin, nylon resin, and paper, and (ii) an overcoat layer made of an electroconductive material such as Al, Ni, Cr, Zn, stainless steel, carbon, $SnO_2$, and $In_2O_3$, formed on the insulating material by vacuum-deposition, sputtering, or spray-coating method.

As mentioned previously, the charge generation layer may comprise a charge generating material and an aliphatic alcohol.

Examples of an aliphatic alcohol for use in the charge generation layer are a monohydric aliphatic alcohol having 5 or more carbon atoms, preferably 12 or more carbon atoms, and a dihydric aliphatic alcohol having 2 or more carbon atoms, preferably 6 to 18 carbon atoms.

Specific examples of the monohydric aliphatic alcohol n-hexyl alcohol, n-heptyl alcohol, pentamethyl ethyl alcohol, n-octyl alcohol, n-nonylalcohol, lauryl alcohol, myristyl alcohol, ceptyl alcohol, stearyl alcohol, n-eicosyl alcohol, n-docosanol, ceryl alcohol, n-octacosyl alcohol, n-triacontyl alcohol, and melissyl alcohol. Among them, higher monohydric aliphatic alcohols having 12 or more carbon atoms, such as lauryl alcohol, myristyl alcohol, cetyl alcohol, stearyl alcohol, n-eicosyl alcohol, n-docosanol, and ceryl alcohol are more preferable for use in the present invention.

Specific examples of the dihydric aliphatic alcohol are ethylene glycol, propylene glycol, ethylethylene glycol, 2,3-butanediol, 2-methyl-1,2-propanediol, 1,2-pentanediol, 2,3-pentanediol, threo-2,3-pentanediol, erythro-2,3-pentanediol, 3-methyl-1,2-butanediol, 2-methyl-1,2-butanediol, 2-methyl-2,3-butanediol, pinacol, trimethylene glycol, 1,3-butanediol, 2,4-pentanediol, 2-methyl-2,4-butanediol, 2-methyl-2,4-pentanediol, 2,4-dimethyl-2,4-pentanediol, hexamethyl trimethylene glycol, 2,2-dimethyl trimethylene glycol, 2,2-dimethyl-1,3-bubanediol, 2,2-dimethyl-1,3-pentanediol, tetramethylene glycol, 2,2,4-trimethyl-1,3-pentanediol, γ-pentylene glycol, 2-methyl-2,5-pentanediol, 3-methyl-2,5-pentanediol, 1,4-hexanediol, 2,5-hexanediol, 2,5-dimethyl-2,5-hexanediol, pentamethylene glycol, 1,5-hexanediol, hexamethylene glycol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,12octadecanediol, and 1,18-octadecanediol.

Furthermore, as mentioned previously, the charge generation layer may comprise a charge generating material and a crown ether. It is preferable that the crown ether have 3 to 8 oxygen atoms for forming the ring thereof.

Specific examples of the crown ethers are as follows:

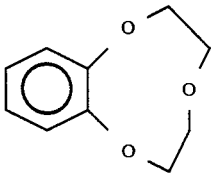

Benzo-9-crown-3-ether

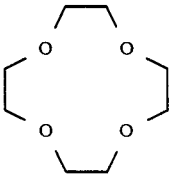

12-crown-4-ether

-continued

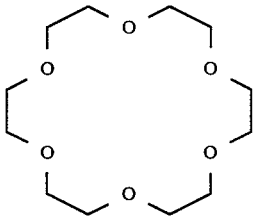

18-crown-6-ether

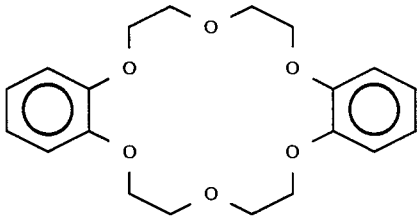

Dibenzo-18-crown-6-ether

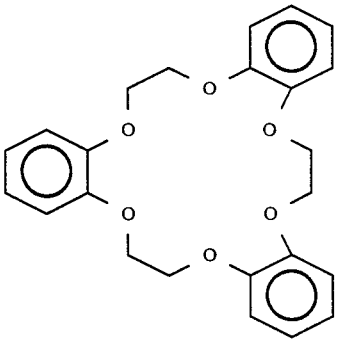

Tribenzo-18-crown-6-ether

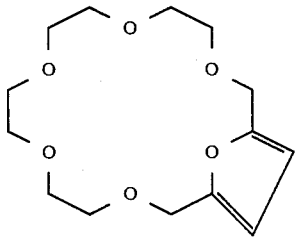

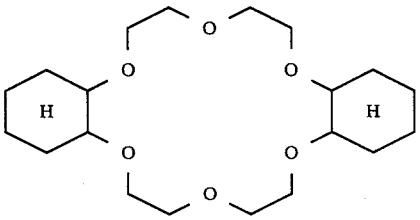

Perhydrobenzo-18-crown-6-ether

-continued

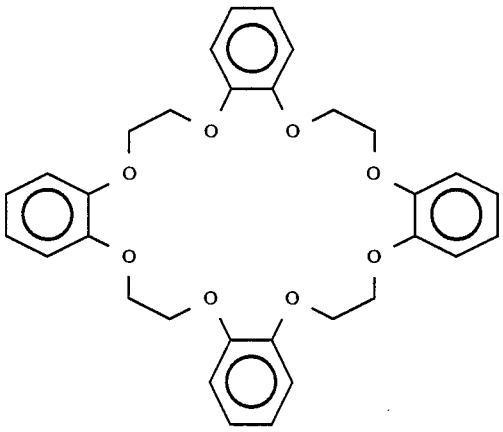

Tetrabenzo-24-crown-8-ether

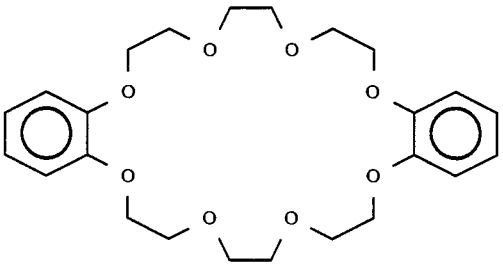

Dibenzo-24-crown-8-ether

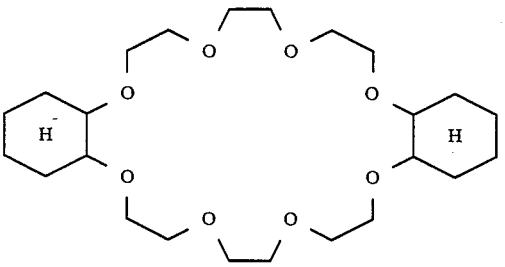

Dicyclohexano-24-crown-8-ether

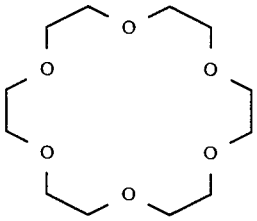

18-crown-6-ether

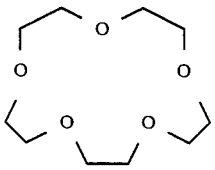

15-crown-5-ether

-continued

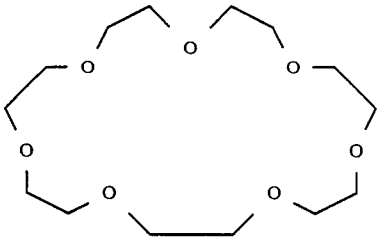

21-crown-7-ether

In the present invention, the following thermoplastic and thermosetting resin binders can be employed in combination with any of the above-mentioned monohydric and dihydric aliphatic alcohols and crown ethers when necessary: polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyacrylate resin, phenoxy resin, polycarbonate, cellulose acetate resin, ethylcellulose resin, polyvinyl butyral, polyvinyl-formal, polyvinyl toluene, poly-N-vinylcarbazole, acrylic resin, silicone resin, epoxy resin, melamine resin, urethane resin, phenolic resin, and alkyl resin.

It is preferable that the amount of such a resin binder be in the range of 0.01 wt. % to 200 wt. %, more preferably in the range of 1 wt. % to 50 wt. %, of the entire weight of a charge generating material. Furthermore it is preferable that the amount of any of the monohydric and dihydric aliphatic alcohols and crown ethers be more than 0.01 wt. %, more preferably 1 wt. % or more of the entire weight of a charge generating material.

As the charge generating material, the following can be employed in the present invention: Organic pigments, such as C.I. Pigment Blue 25 (C.I. 21180), C.I. Pigment Red 41 (C.I. 21200), C.I. Acid Red 52 (C.I. 45100), and C.I. Basic Red 3 (C.I. 45210); a phthalocyanine pigment having a porphyrin skeleton; an azulenium salt pigment; a squaric pigment; an azo pigment having a carbazole skeleton (Japanese Laid-Open patent application No. 53-95033), an azo pigment having a styrylstilbene skeleton (Japanese Laid-Open patent application No. 53-138229), an azo pigment having a triphenylamine skeleton (Japanese Laid-Open patent application No. 53-132547), an azo pigment having a dibenzothiophene skeleton (Japanese Laid-Open patent application No. 54-21728), an azo pigment having an oxadiazole skeleton (Japanese Laid-Open patent application No. 54-12742), an azo pigment having a fluorenone skeleton (Japanese Laid-Open patent application No. 54-22834), an azo pigment having a bisstilbene skeleton (Japanese Laid-Open patent application No. 54-17733), an azo pigment having a distyryl oxadiazole skeleton (Japanese Laid-Open patent application No. 54-2129), an azo pigment having a distyryl carbazole skeleton (Japanese Laid-Open patent application No. 54-17734), a trisazo pigment having a carbazole skeleton (Japanese Laid-Open patent application Nos. 57-195767 and 57-195768); a phthalocyanine-type pigment such as C.I. Pigment Blue 16 (C.I. 74100); Indigo-type pigments such as C.I. Vat Brown 5 (C.I. 73410) and C.I. Vat Dye (C.I.73030); and perylene-type pigments such as Algo Scarlet B (made by Biolet Co., Ltd.), and Indanthrene Scarlet R (made by Bayer Co., Ltd).

In the above-mentioned charge generating materials, azo pigments are preferable, and the most preferable are disazo or trisazo pigments.
TABLE 1
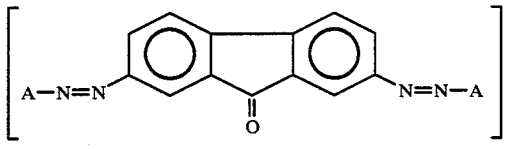
| Pigment No. | A |
|---|---|
| 1 | 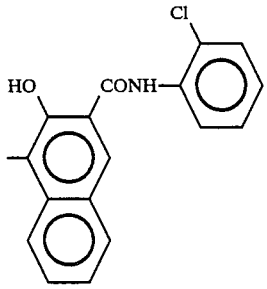 |
| 2 | 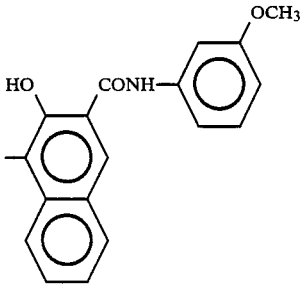 |
| 3 | 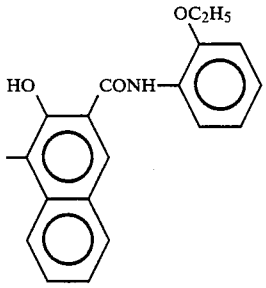 |
| 4 | 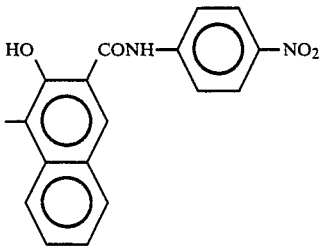 |

TABLE 1-continued
5
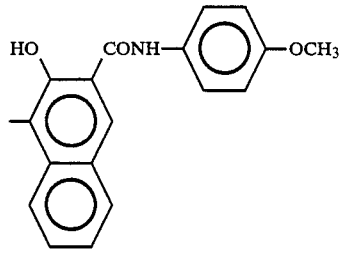
6
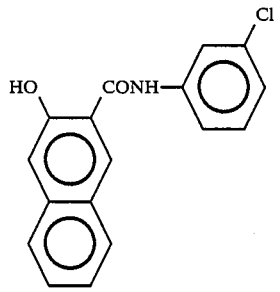
7
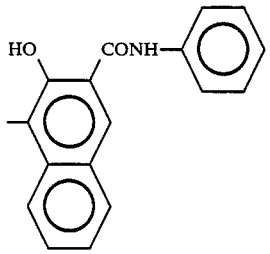
8
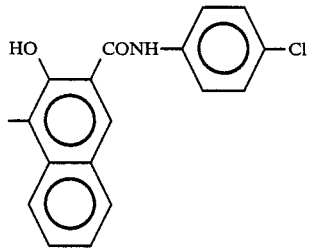
9
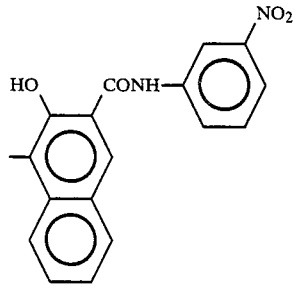

TABLE 1-continued
10
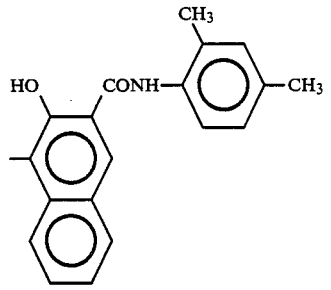
11
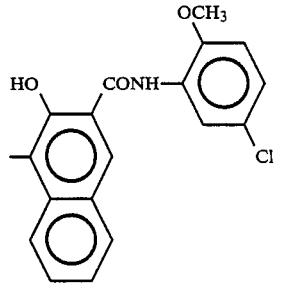
12
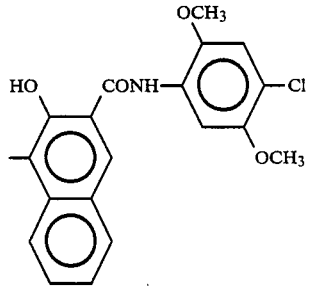
13
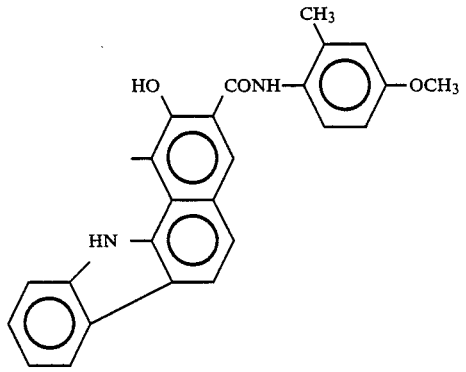
14
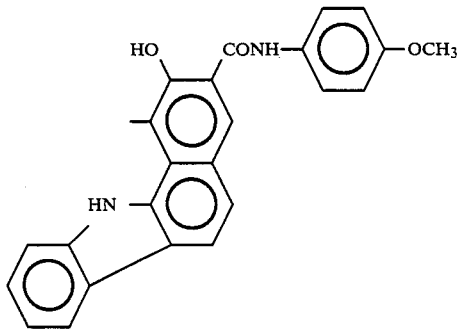

TABLE 1-continued
15
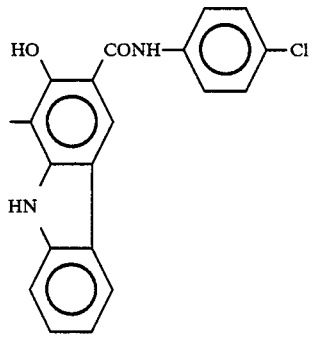
16
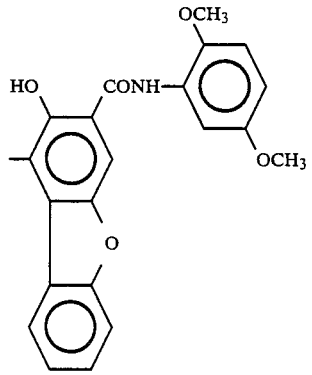
17
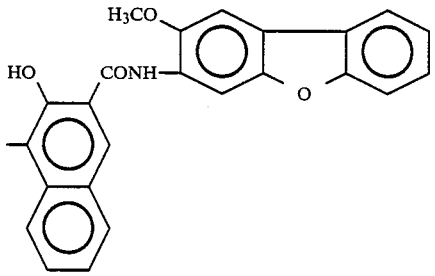
18
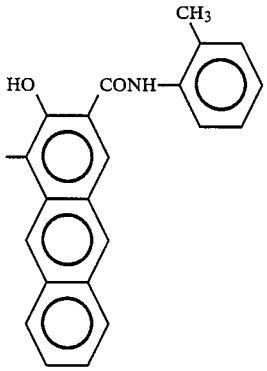

TABLE 1-continued
19
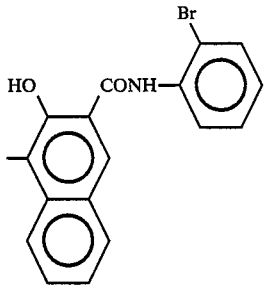
20
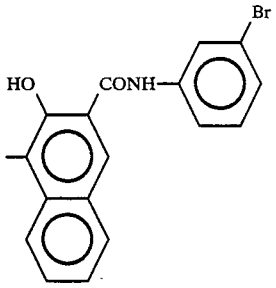
21
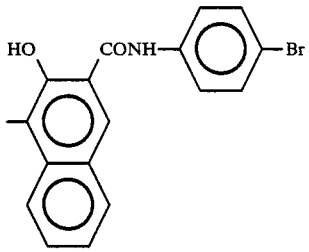
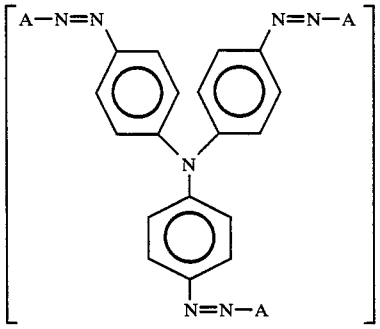
| Pigment No. | A |
|---|---|
| 22 | 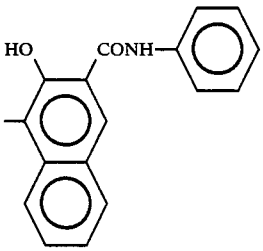 |

TABLE 1-continued
23
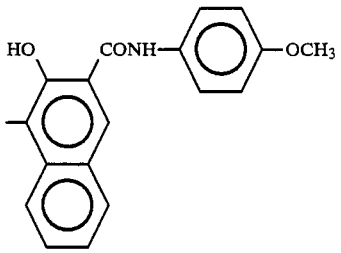
24
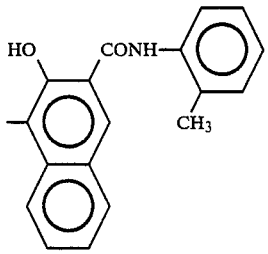
25
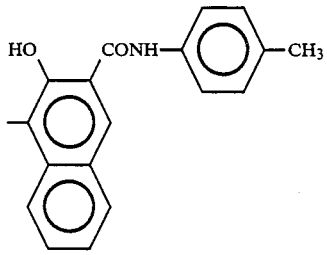
26
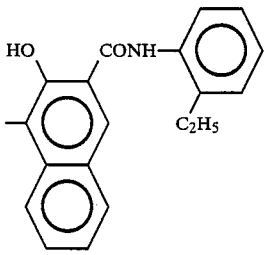
27
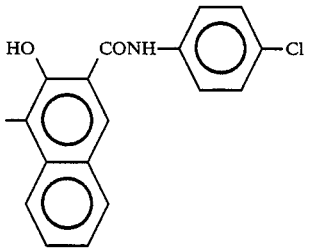
28
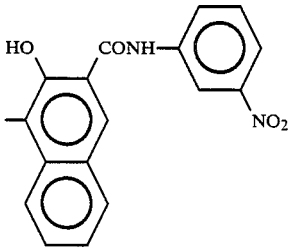

TABLE 1-continued
29
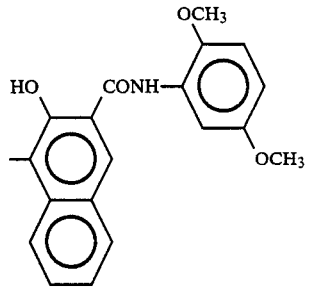
30
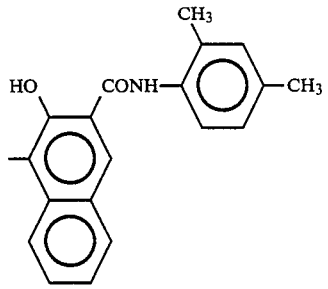
31
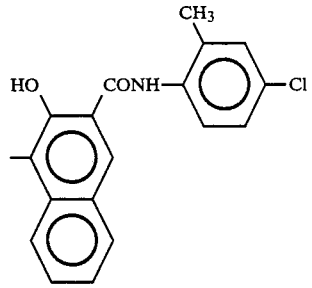
32
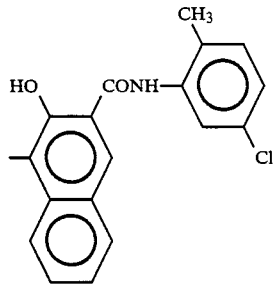
33
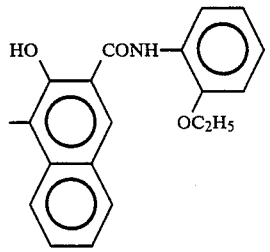

TABLE 1-continued
34
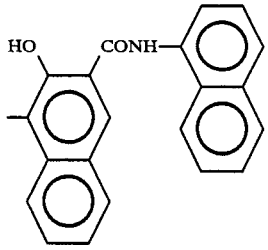
35
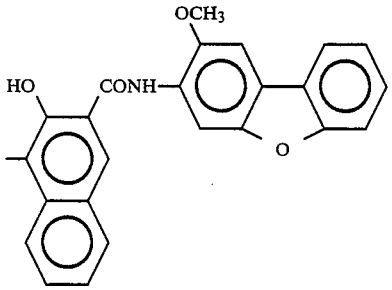
36
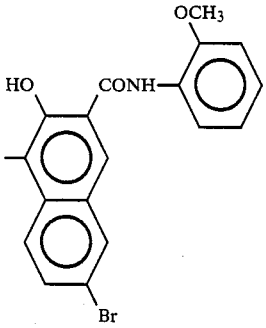
37
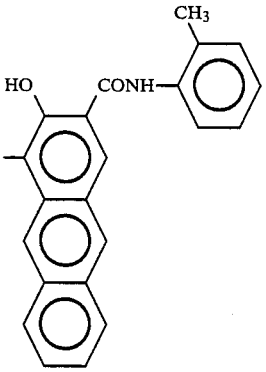
38
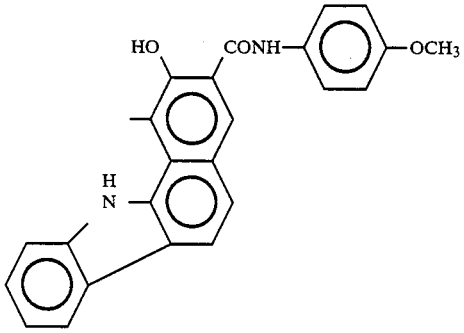

TABLE 1-continued
39
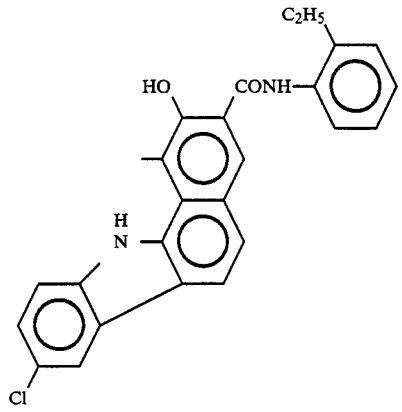
40
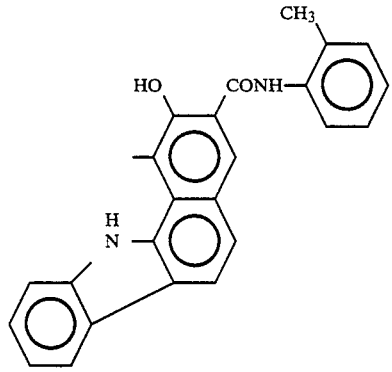
41
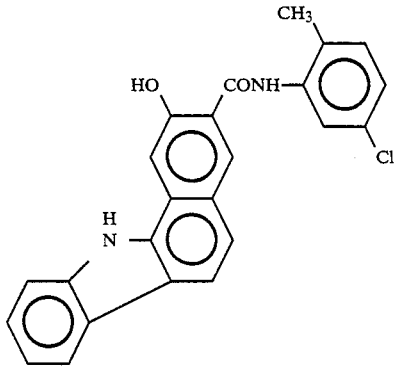
42
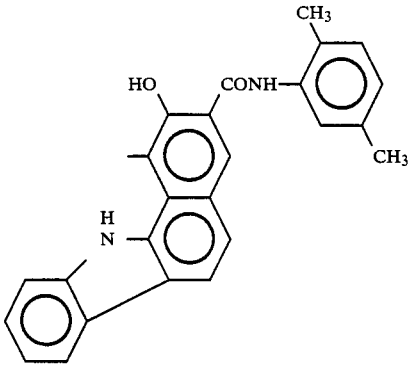

TABLE 1-continued
43
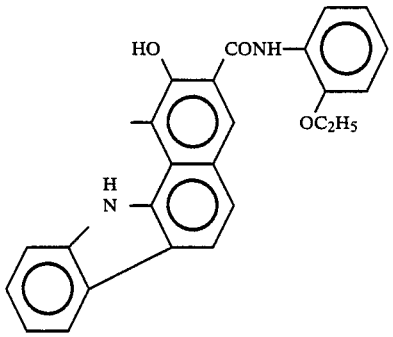
44
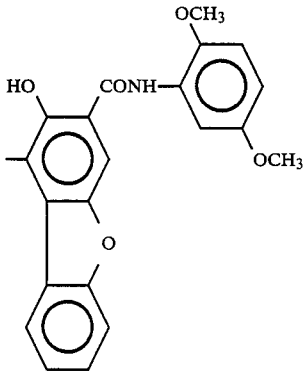
45
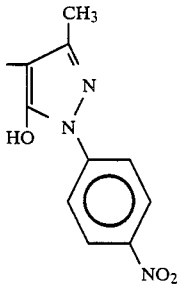
46
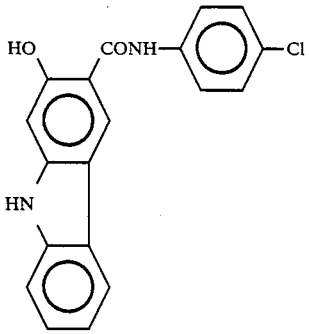

TABLE 1-continued
47
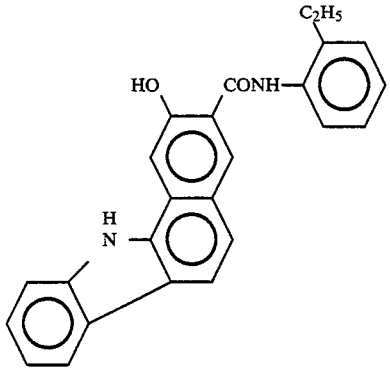
48
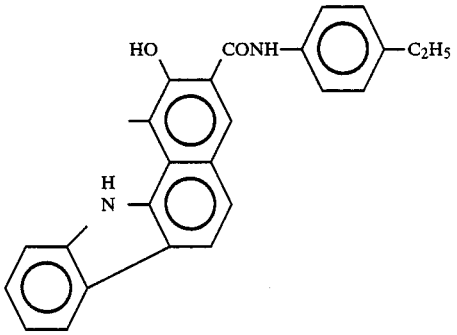
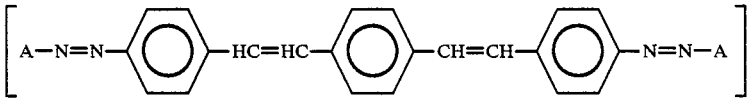
| Pigment No. | A |
|---|---|
| 49 | 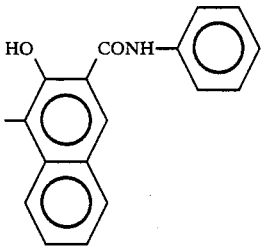  |
| 50 | 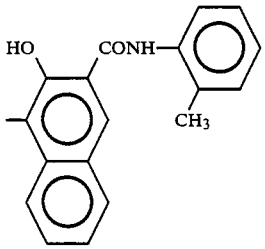  |

TABLE 1-continued
51
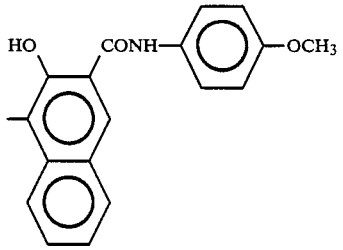
52
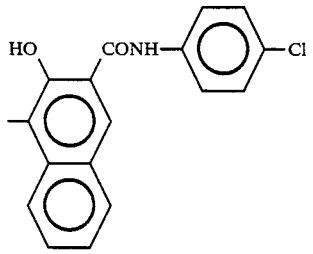
53
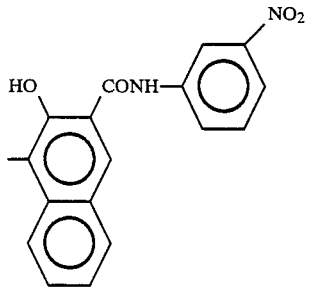
54
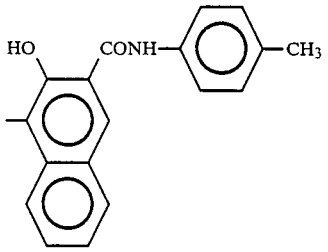
55
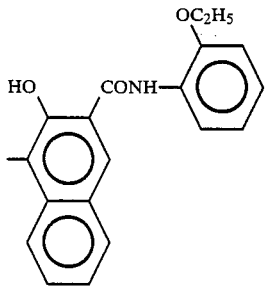

TABLE 1-continued
56
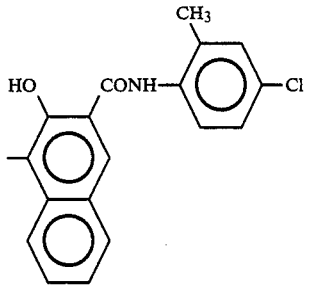
57
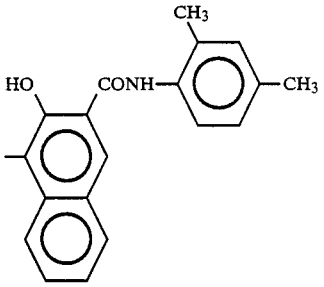
58
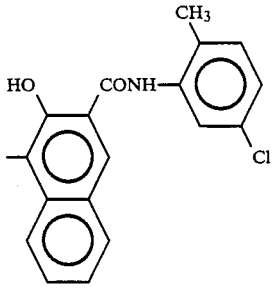
59
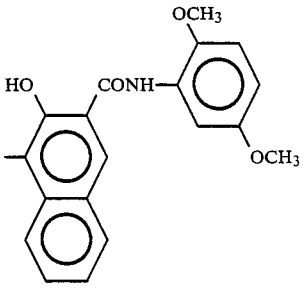
60
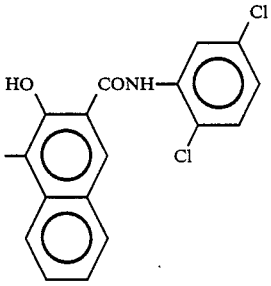

TABLE 1-continued
61
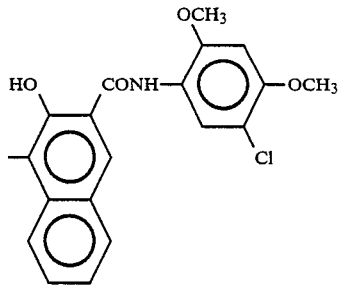
62
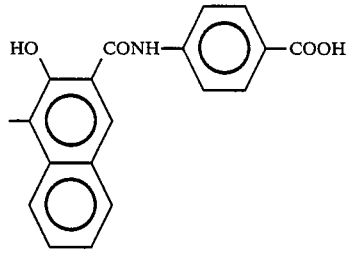
63
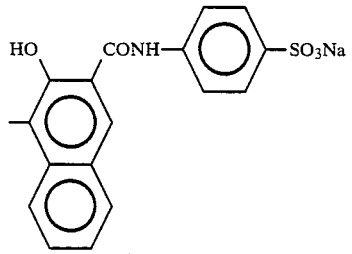
64
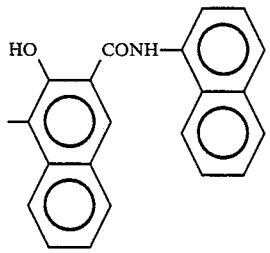
65
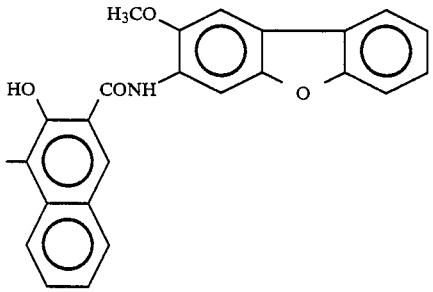

TABLE 1-continued
66
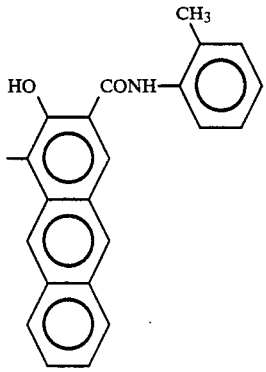
67
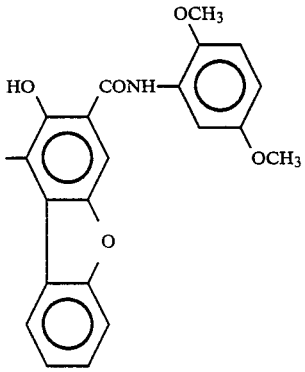
68
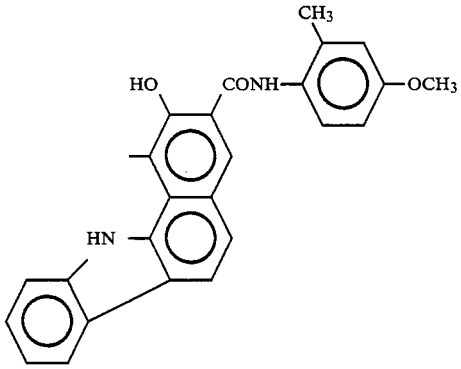
69
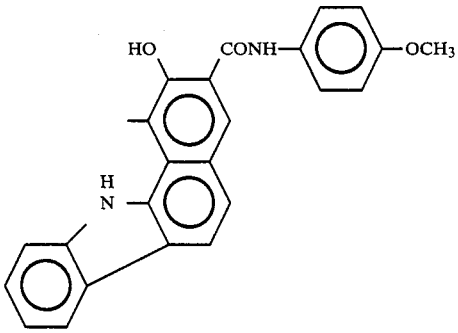

TABLE 1-continued

| | |
|---|---|
| 70 | 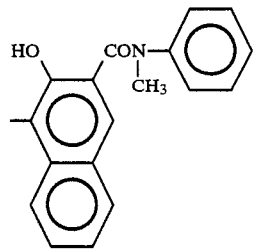 |
| 71 | 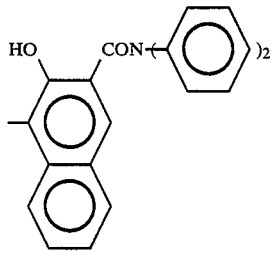 |
| 72 | 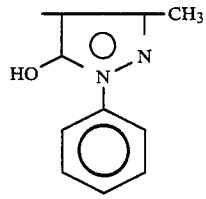 |
| 73 | 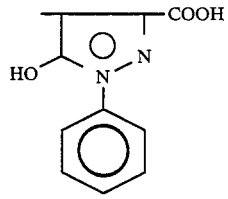 |
| 74 | 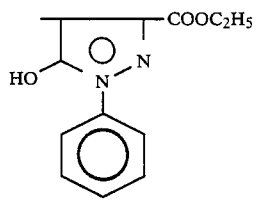 |

It is preferable that the thickness of a charge generation layer 13 be in the range of about 0.05 μm to about 5 μm.

The charge generation layer 13 can be formed, for example, as follows:

A charge generating material, with further addition of a binder resin when necessary, is dispersed together with a solvent such as benzene, toluene, xylene, methylene chloride, dichloroethane, monochlorobenzene, dichlorobenzene, ethyl acetate, butyl acetate, methyl ethyl ketone, dioxane, tetrahydrofuran, cyclohexanone, methyl cellosolve, and ethyl cellosolve to prepare a dispersion of the charge generating material. This dispersion, appropriately diluted, is coated, for instance, on an electroconductive support, an intermediate layer, or a charge transport layer and then dried, so that a charge generation layer is formed. The above solvents can be employed alone or in combination.

As mentioned previously, the charge transport layer 14 which comprises a charge transporting material and one component selected from the group consisting of an aliphatic alcohol, a polyalkylene glycol, a polyalkylene glycol ester, a polyalkylene glycol ether, and a crown ether, can be formed on the charge generation layer 13, the intermediate layer 12 or the electroconductive support 11, by coating a charge transport layer coating liquid.

The charge transport layer coating liquid can be prepared by dissolving or dispersing a charge transporting material, a binder agent and one component selected from the group consisting of an aliphatic alcohol, a polyalkylene glycol, a polyalkylene glycol ester, a polyalkylene glycol ether, and a crown ether in an appropriate solvent. When necessary, a plasticizer and/or a levelling agent can be added to the charge transport layer coating liquid.

Examples of an aliphatic alcohol for use in the charge transport layer are a monohydric aliphatic alcohol and a dihydric aliphatic alcohol.

It is preferable that the monohydric aliphatic alcohol have 10 or more carbon atoms. Specific examples of the monohydric aliphatic alcohol are n-decyl alcohol, n-undecyl alcohol, dodecyl alcohol, n-tridecyl alcohol, n-tetradecyl alcohol, pentadecyl alcohol, hexadecyl alcohol, n-heptadecyl alcohol, octadecyl alcohol, 1-eicosanol and 1-docosanol.

It is preferable that the dihydric aliphatic alcohol have 5 or more carbon atoms. Specific examples of the dihydric aliphatic alcohol are 2,2-dimethyl-1,3-propanediol, 2-ethyl-1,3-propanediol, 1,5-pentanediol, 2,4-pentanediol, 1,6-hexanediol, 2,5-hexanediol, 2-methyl-2,4-pentanediol, 2-propyl-1,3-propanediol, 2-butyl-1,3-propanediol, 1,8-octanediol, 2-pentyl-1,3-propanediol, 2-ethyl-1,3-hexanediol, 2,2,4-trimethyl-1,3-pentanediol, 1,10-decanediol, and 1,12-dodecanediol.

It is preferable that the amount of any of the above aliphatic alcohols in the charge transport layer be in the range of 0.1 ~ 20 parts by weight, more preferably in the range of 0.2 ~ 10 parts by weight, to 100 parts by weight of a mixture of a charge transporting material and a binder resin, for obtaining excellent photosensitivity.

Examples of a polyalkylene glycol for use in the charge transport layer are polyethylene glycol, polypropylene glycol, polybuthylene glycol and a random copolymer and a block copolymer of hydroxyethylene and hydroxypropylene, which are commercially available.

As polyethylene glycol for use in the charge transport layer, those having a molecular weight of 106 ~ 5,000,000, more preferably those having a molecular weight of 200 ~ 50,000 are suitable.

In particular, polyethylene glycol having a molecular weight of 10,000 or more is called "polyethylene oxide".

As polypropylene glycol for use in the charge transport layer, those having a molecular weight of 130 ~ 500,000, more preferably those having a molecular weight of 500 ~ 3,000 are suitable.

As polybutylene glycol for use in the charge transport layer, those having a molecular weight of 160 ~ 100,000, more preferably those having a molecular weight of 500 ~ 3,000 are suitable.

As a random copolymer and a block copolymer of hydroxyethylene and hydroxypropylene, those having a molecular weight of 200 ~ 500,000, more preferably those having a molecular weight of 500 ~ 50,000, with an average number of added moles of hydroxyethylene group being in the range of 0.1 mole % ~ 99.9 mole %.

It is preferable that the amount of any of the above polyalkylene glycols in the charge transport layer be in the range of 0.1 ~ 10 parts by weight, more preferably in the range of 0.2 ~ 6 parts by weight, to 100 parts by weight of a mixture of a charge transporting material and a binder resin, for obtaining excellent photosensitivity.

Examples of a polyalkylene glycol ester for use in the present invention are polyethylene glycol monocarboxylic acid ester, polyethylene glycol dicarboxylic acid ester, and a carboxylic acid ester of polyoxysorbitan, which are commercially available.

Specific examples of polyethylene glycol monocarboxylic acid ester are Ionet MS-400, MS-1000, MO-200, MO-400, MO-600, and Santopearl TE-106 (made by Sanyo Chemical Industries, Ltd.); Noigen ES Series (made by Dai-Ichi Kogyo Seiyaku Co., Ltd.); and Nonion L-Series, Nonion S-Series, Nonion O-Series, and Nonion T-Series (made by Nippon Oils & Fats Co., Ltd.).

Specific examples of a polyethylene glycol dicarboxylic acid ester are Ionet DL-200, DS-300, DS-400, DO-200, DO-400, DO-600, DO-1000, and Santopearl GE-70, and Nonion DS-60HN (distearate) (made by Nippon Oils & Fats Co., Ltd.)

Specific examples of a carboxylic acid ester of polyoxysorbitan are Tween (made by Atlas Powder Co., Ltd.), Ionet T-20C, T-60C. and T-80C; Adeka Estol T-62 and T-82 (made by Asahi Denka Kogyo K.K.); and Nonion LT-221, PT-221, ST-221, and OT-221 (made by Nippon Oils & Fats Co., Ltd.).

It is preferable that the amount of any of the above polyalkylene glycol esters in the charge transport layer be in the range of 0.1 ~ 10 parts by weight, more preferably in the range of 0.2 ~ 6 parts by weight, to 100 parts by weight of a mixture of a charge transporting material and a binder resin, for obtaining excellent photosensitivity.

Examples of a polyalkylene glycol ether for use in the charge transport layer are a polyethylene glycol monoether, a polypropylene glycol monoether and a monoether of a copolymer of hydroxyethylene and hydroxypropylene, which are commercially available.

The polyethylene glycol monoether is represented by the following formula:

$$R—O—(CH_2CH_2)_nH$$

wherein R represents an alkyl group having 1 to 30 carbon atoms, preferably an alkyl group having 10 to 20 carbon atoms; or an unsubstituted or substituted aryl group, preferably a phenyl group having as a substituent an alkyl group having 1 to 20 carbon atoms; and n indicates an average number of added moles, which is an integer of 1 or more, more preferably 2 to 1,000.

Specific examples of the polyethylene glycol monoether are as follows:

Emulmin 40, 50, 60, 70, 110, 140, 180, M-20, 240, L-90-S, L-380 (made by Sanyo Chemical Industries, Ltd.); Adeka Estol OEG Series and Adeka Estol SEG Series; Noigen ET Series, and Emulsit L Series (made by Dai-Ichi Kogyo Seiyaku Co., Ltd.); Nonion E-206, E-215, E-230, P-208, P-210, P-213, S-207, S-215, S-220, K-204, K-215, K-220, K-230, T-2085, and Persoft NK-60, NK-100; Nonipol 20, 30, 40, 55, 60, 70, 85, 90, 95, 100, 110, 120, 130, 140, 160, 200, 290, 300, 400, 450, 500, 700, 800, D160, Octapol 45, 50, 60, 80, 100, 200, 300, 400 and Dodecapol 61, 90, 120, 200 (made by Sanyo Chemical Industries, Ltd.); Noigen EA Series, and Emulsit Series (made by Dai-Ichi Kogyo Seiyaku Co., Ltd.); Nonion NS Series, HS Series, and Uniox M-400, M-550, M-200, C-2300.

The polypropylene glycol monoether is represented by the following formula:

$$R—O—(C_3H_6O)_nH$$

wherein R represents an alkyl group having 1 to 30 carbon atoms, preferably an alkyl group having 10 to 20 carbon atoms; or an unsubstituted or substituted aryl group, preferably a phenyl group having as a substituent an alkyl group having 1 to 20 carbon atoms; and n indicates an average number of added moles, which is an integer of 1 or more, preferably 5 to 100.

Specific examples of the polypropylene glycol monoether are Newpol LB65, Newpol LB285, Newpol LB385, Newpol LB125, Newpol LB1145, Newpol LB1715, Newpol LB3000, Newpol LB300X, Newpol LB400XY, Newpol LB650X and Newpol LB1800X (made by Sanyo Chemical Industries Ltd.).

The monoether of the copolymer of hydroxyethylene and hydroxypropylene is conventionally well-known. In the present invention, commercially available monoethers can be employed. It is preferable that such monoethers for use in the present invention have a molecular weight ranging from 200 to 20,000, preferably from 200 to 4,000.

Specific examples of the monoether of the copolymer are Newpol 50HB-55, 50HB-100, 50HB-260, 50HB-400, 50HB-660, 50HB-2000, and 50HB-5100 (made by Sanyo Chemical Industries Ltd.).

It is preferable that the amount of any of the above polyalkylene glycol ethers in the charge transport layer be in the range of 0.1 ~ 10 parts by weight, more preferably in the range of 0.2 ~ 6 parts by weight, to 100 parts by weight of a mixture of a charge transporting material and a binder resin for obtaining excellent photosensitivity.

It is preferable that a crown ether for use in the charge transport layer includes 3 to 8 oxygen atoms in the ring thereof.

Examples of such a crown ether are benzo-9-crown-3-ether, 12-crown-4-ether, 18-crown-6-ether, dibenzo-18-crown-6-ether, tribenzo-18-crown-6-ether, dibenzo-24-crown-8-ether, dicyclohexano-24-crown-8-ether, dicyclohexano-18-crown-6-ether, tetrabenzo-24-crown-8-ether, 18-crown-6-ether, 15-crown-5-ether, 21-crown-7-ether, poly(dibenzo-18-crown-6-ether) having the following formula,

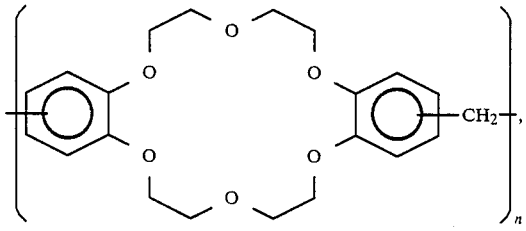

and

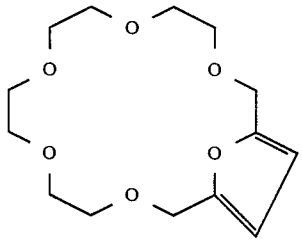

It is preferable that the amount of any of the above crown ethers in the charge transport layer be in the range of 0.1 ~ 20 parts by weight, more preferably in the range of 0.2 ~ 10 parts by weight, to 100 parts by weight of a mixture of a charge transporting material and a binder resin, for obtaining excellent photosensitivity.

Specific examples of a charge transporting material are a positive hole transporting material and an electron transporting material. Specific examples of a positive hole transporting material are poly-N-vinylcarbazole and derivatives thereof, poly-γcarbazolyl ethyl glutamate and derivatives thereof, pyrene-formaldehyde condensate and derivatives thereof, polyvinyl pyrene, polyvinyl phenanthrene, oxazole derivatives, oxadiazole derivatives, imidazole derivatives, triphenylamine derivatives, 9-(p-diethylaminostyryl) anthracene, 1,1-bis-(4-dibenzylaminophenyl)propane, styryl anthracene, styryl pyrazoline, phenylhydrazones, and α-phenylstilbene derivatives, which are electron doners.

Specific examples of an electron transporting material are chloroanil, bromoanil, tetracyanoethylene, tetracyanoquinonedimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, and 1,3,7-trinitrobenzothiophenone-5,5-dioxide, which are electron acceptors.

As the resin binder for use in the charge transport layer, the following thermoplastic and thermosetting resins can be employed: polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyacrylate resin, phenoxy resin, polycarbonate, cellulose acetate resin, ethylcellulose resin, polyvinyl butyral, polyvinyl formal, polyvinyl toluene, poly-N-vinylcarbazole, acrylic resin, silicone resin, epoxy resin, melamine resin, urethane resin, phenolic resin, and alkyd resin.

As the solvent for preparing the coating dispersions of the charge transporting layer, tetrahydrofuran, dioxane, toluene, monochlorobenzene, dichloroethane, and methylene chloride can be employed.

It is preferable that the thickness of the charge transport layer 13 be in the range of about 5 μm to about 100 μm.

In the present invention, an intermediate layer 12 can be interposed between the electroconductive support 11 and the charge generation layer 13 or between the electroconductive support 11 and the charge transport layer 14 as shown in FIG. 2 and FIG. 4.

The intermediate layer can be a light-scattering layer or a light-absorbing layer for preventing the light interference in a photoconductor used for a printer. A light-scattering intermediate layer can be prepared by dispersing finely-divided electroconductive particles such as tin oxide and antimony oxide, and white pigments such as zinc oxide, zinc sulfide and titanium oxide in a thermosetting resin, while a light-absorbing intermediate layer can be prepared by dispersing an electroconductive light-absorbing pigment such as carbon and metals and/or light-absorbing organic pigments in the same or similar resin as that employed in the light-scattering layer. The thermosetting resin can be prepared by thermal polymerization of a compound having a plurality of active hydrogens (for instance, hydrogen as in —OH, —$NH_2$, and —NH groups) and a compound having a plurality of isocyanate groups and/or a compound having a plurality of epoxy groups. As such compounds having a plurality of active hydrogens, for instance, polyvinyl butyral, phenoxy resin, phenol resin, polyamide, polyester, polyethylene glycol, polypropylene glycol, polybutylene glycol, and acrylic resins having a hydroxyethyl methacrylate group containing an active hydrogen can be given. As compounds having a plurality of isocyanate groups, tolylene diisocyanate, hexamethylene diisocyanate, diphenylmethane diisocyanate, and prepolymers thereof can be employed. As a compound having a plurality of epoxy groups, bisphenol A and epoxy resin can be given.

The light-scattering and the light-absorbing layer can be prepared by applying the above-mentioned dispersion on the substrate and thermally polymerizing the same at temperatures of 50° C. to 200° C. It is preferable that the thickness of the intermediate layer be in the range of 1 μm to 10 μm. It is preferable that the weight ratios of the finely-divided electroconductive particles to white pigments to the thermosetting resin be (2~6): (1~5): (2~6), and the weight ratio of the light-absorbing pigment to the thermosetting resin be (4~9): (1~6).

The advantages of the present invention can be further improved and the adhesiveness of the electroconductive support 11 and the charge generation layer 13 can be further strengthened by providing the intermediate layer 12 between the electroconductive support 11 and the charge generation layer 13 as shown in FIG. 2 and FIG. 4.

The above intermediate layer can be provided by vacuum deposition, sputtering and anodic oxidation of an inorganic material such as SiO and $Al_2O_3$, or made of polyamide resins (Japanese Laid-Open patent application Nos. 58-30757 and 58-98739), an alcohol-soluble nylon resin (Japanese Laid-Open patent application No. 60-196766), a water-soluble polyvinyl butyral resin (Japanese Laid-Open patent application No. 60-232553), a polyvinyl butyral resin (Japanese Laid-Open patent application No. 58-106549) and a polyvinyl alcohol.

Furthermore, a resinous intermediate layer in which pigment particles of ZnO, $TiO_2$ or ZnS are dispersed can be employed.

A silane coupling agent, a titanium coupling agent and a chromium coupling agent may also be used for the intermediate layer 12. It is preferable that the thickness of the intermediate layer 12 be in the range of 0~5 μm.

In the present invention, an insulation layer or a protective layer may be formed on the photoconductive layer comprising the charge transport layer and the charge generation layer.

The present invention will now be explained in detail with reference to the following examples, which are given for illustration of the invention and are not intended to be limiting thereof.

EXAMPLE 1-1

[Preparation of Charge Generation Layer Coating Liquid]

A mixture of 5 parts by weight of Azo Pigment (Pigment No. 1 in Table 1) and 160 parts by weight of a cyclohexanone solution containing 0.78 wt. % of n-stearyl alcohol was dispersed in a ball mill for 72 hours, whereby a pigment dispersion was prepared. To 100 parts by weight of the thus prepared pigment dispersion, 90 parts by weight of methyl ethyl ketone were added with stirring, so that a charge generation layer coating liquid was prepared.

[Preparation of Charge Transport Layer Coating Liquid]

A mixture of the following components was mixed and dispersed, whereby a charge transport layer coating liquid was prepared:

| | Parts by Weight |
|---|---|
| α-phenylstilbene type charge transporting material of the following formula: | 100 |

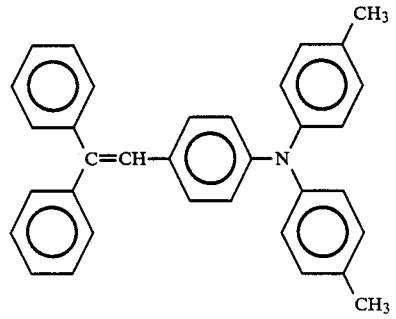

| | |
|---|---|
| Polycarbonate (Trademark "Panlite C-1400" made by Teijin Limited) | 100 |
| Silicone oil (Trademark "KF 50" made by Shin-Etsu Chemical Co., Ltd.) | 0.1 |
| Tetrahydrofuran | 800 |

The thus prepared charge generation layer coating liquid was coated by a doctor blade on an Al-deposited polyester film substrate formed by vacuum deposition having a thickness of 75 μm, and dried at 120° C. for 10 minutes so that a charge generation layer having a thickness of about 0.2 μm was formed on the film.

On the charge generation layer, the above prepared charge transport layer coating liquid was coated by a doctor blade and dried at 120° C. for 20 minutes, so that a charge transport layer having a thickness of about 20 μm was formed on the charge generation layer, whereby an electrophotographic photoconductor No. 1-1 according to the present invention was prepared.

EXAMPLE 1-2

The same charge transport layer coating liquid as that employed in Example 1-1 was coated by a doctor blade on a 75 μm thick Al-deposited polyester film substrate formed by vacuum deposition and dried, so that a charge transport layer having a thickness of about 20 μm was formed on the polyester film substrate.

On the thus prepared charge transport layer, the same charge generation layer coating liquid as that employed in Example 1-1 was coated by spray coating, and dried at 120° C. for 30 minutes, so that a charge generation layer having a thickness of about 0.2 μm was formed on the charge transport layer, whereby an electrophotographic photoconductor No. 1-2 according to the present invention was prepared.

EXAMPLE 1-3

Example 1-1 was repeated except that the cyclohexanone solution containing 0.78 wt. % of n-stearyl alcohol in the formulation of the charge generation layer coating liquid in Example 1-1 was replaced by a cyclohexanone solution containing 0.156 wt. % of n-docosanol, whereby an electrophotographic photoconductor No. 1-3 according to the present invention was prepared.

COMPARATIVE EXAMPLE 1-1

Example 1-1 was repeated except that n-stearyl alcohol employed in the formulation of the charge generation layer coating liquid in Example 1-1 was replaced by polyvinyl butyral (Trademark "XYHL" made by Union Carbide Japan K.K.), whereby a comparative electrophotographic photoconductor No. 1-1 was prepared.

COMPARATIVE EXAMPLE 1-2

Example 1-1 was repeated except that n-stearyl alcohol employed in the formulation of the charge generation layer coating liquid in Example 1-1 was replaced by polyester (Trademark "Vylon 200" made by Toyobo Co., Ltd.), whereby a comparative electrophotographic photoconductor No. 1-2 was prepared.

By use of a Paper Analyzer (Kawaguchi Electro Works, Model SP-428), each of the electrophotographic photoconductors No. 1-1 and No. 1-3 and comparative photo conductors No. 1-1 and 1-2, each having a layered structure as shown in FIG. 1, was negatively charged in the dark under application of −6 kV of corona charge for 20 seconds. During the corona charge application, the surface potential V (volts) of the photoconductor was measured 2 seconds after the initiation of the charging of the photoconductor by the corona charge. The photoconductor was then allowed to stand in the dark without applying any charge thereto until the surface potential of the photoconductor became −800V. At this moment, the photoconductor was illuminated by a tungsten lamp, so that the exposure S(lux·sec) required for reducing the surface potential to −400V by the light exposure was measured.

The electrophotographic photoconductor No. 1-2 having a layered structure as shown in FIG. 3, was positively charged in the dark under application of +7 kV of corona charge for 20 seconds. During the corona charge application, the surface potential V (volts) of the photoconductor was measured 2 seconds after the initiation of the charging of the photoconductor by the corona charge. The photoconductor was then allowed to stand in the dark without applying any charge thereto until the surface potential of the photoconductor became +800V. At this moment, the photoconductor was illuminated by a tungsten lamp, so that the exposure S(lux·sec.) required for reducing the surface potential to +80V by the light exposure was measured.

Each of the above photoconductors was exposed to the light of 100,000 lux·sec by use of a tungsten lamp with a color temperature of 2856° K. and was then subjected to the same charging and exposing process as mentioned above, so that the corresponding surface potential V′ (V) and exposure S′ (lux·sec) of the photoconductor was measured. The results are shown in Table 2.

TABLE 2

| | Charge Generation Layer Azo Pigment No./Aliphatic Alcohol | Before Fatigue V (Volts) | Before Fatigue S (lux · sec) | After Fatigue V′ (Volts) | After Fatigue S′ (lux · sec) |
|---|---|---|---|---|---|
| Example 1-1 | Azo Pigment No. 1/ n-stearyl alcohol: 4/1 | −887 | 0.51 | −830 | 0.49 |
| Example 1-2 | Azo Pigment No. 1/ n-stearyl alcohol: 4/1 | +912 | 0.54 | +900 | 0.51 |
| Example 1-3 | Azo pigment No. 1/ n-docosanol:8/1 | −892 | 0.50 | −816 | 0.49 |
| Comp. Ex. 1-1 | Azo Pigment No. 1/ Polyvinyl Butyrol: 4/1 | −958 | 0.63 | −602 | 0.57 |
| Comp. Ex. 1-2 | Azo Pigment No. 1/ Polyester: 4/1 | −920 | 0.34 | −718 | 0.28 |

EXAMPLE 2-1

[Preparation of Charge Generation Layer Coating Liquid]

A mixture of 5 parts by weight of Azo Pigment (Pigment No. 1 in Table 1) and 160 parts by weight of a cyclohexanone solution containing 0.78 wt. % of 1,12-dodecanediol was dispersed in a ball mill for 72 hours, whereby a pigment dispersion was prepared. To 100 parts by weight of the thus prepared pigment dispersion, 90 parts by weight of methyl ethyl ketone were added with stirring, so that a charge generation layer coating liquid was prepared.

[Preparation of Charge Transport Layer Coating Liquid]

A mixture of the following components was mixed and dispersed, whereby a charge transport layer coating liquid was prepared:

| | Parts by Weight |
|---|---|
| α-phenylstilbene type charge transporting material of the following formula: | 100 |
| Polycarbonate (Trademark "Panlite C-1400" made by Teijin Limited) | 100 |
| Silicone oil (Trademark "KF 50" made by Shin-Etsu Chemical Co., Ltd.) | 0.1 |
| Tetrahydrofuran | 800 |

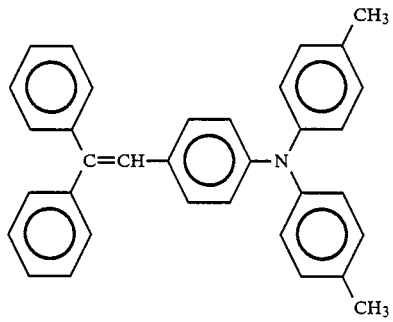

The thus prepared charge generation layer coating liquid was coated by a doctor blade on an Al-deposited polyester film substrate formed by vacuum deposition having a thickness of 75 μm, and dried at 120° C. for 10 minutes so that a charge generation layer having a thickness of about 0.2 μm was formed on the film.

On the charge generation layer, the above prepared charge transport layer coating liquid was coated by a doctor blade and dried at 120° C. for 20 minutes, so that a charge transport layer having a thickness of about 20 μm was formed on the charge generation layer, whereby an electrophotographic photoconductor No. 2-1 according to the present invention was prepared.

EXAMPLE 2-2

Example 2-1 was repeated except that α-phenylstilbene compound employed in the charge transport layer coating liquid in Example 2-1 was replaced by the following charge transporting material, whereby an electrophotographic photoconductor No. 2-2 according to the present invention was prepared:

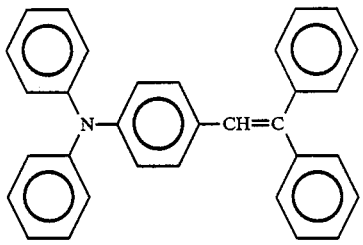

EXAMPLE 2-3

Example 2-1 was repeated except that the cyclohexanone solution containing 0.78 wt. % of 1,12-dodecanediol in the formulation of the charge generation layer coating liquid in Example 2-1 was replaced by a cyclohexanone solution containing 0.156 wt. % of propylene glycol, whereby an electrophotographic photoconductor No. 2-3 according to the present invention was prepared.

EXAMPLE 2-4

Example 2-3 was repeated except that 90 parts by weight of methyl ethyl ketone employed in the charge generation layer coating liquid in Example 2-3 was replaced by 90 parts by weight of a methyl ethyl ketone solution containing 0.67 wt. % of polyvinyl butyral (Trademark "XYHL" made by Union Carbide Japan K.K.), whereby an electrophotographic photoconductor No. 2-4 according to the present invention was prepared.

EXAMPLE 2-5

A mixture of 8 parts by weight of finely-divided tin oxide particles containing 10 wt. % of antimony oxide, 5 parts by weight of titanium oxide white pigment and 68 parts by weight of a methyl ethyl ketone solution containing 12 wt. % of polyvinyl butyral (Trademark "BL-1" made by Sekisui Chemical Co., Ltd.) was dispersed in a ball mill for 72 hours. To this mixture, 47 parts by weight of methyl ethyl ketone were added, and the mixture was further dispersed for 48 hours. To 80 parts by weight of this dispersion, 8 parts by weight of a methyl ethyl ketone solution containing 20 wt. % of tolylene diisocyanate were added with stirring, whereby a light-scattering intermediate layer coating liquid was prepared.

The thus prepared light-scattering intermediate layer coating liquid was coated by a doctor blade on a 75 μm thick Al-deposited polyester film substrate formed by vacuum deposition and dried at 120° C. for 30 minutes, so that the coated liquid was thermally set, whereby a light-scattering intermediate layer having a thickness of about 2.5 μm was formed.

Then the same charge generation layer and charge transport layer as those employed in Example 2-1 were successively formed on the above light-scattering intermediate layer, whereby an electrophotographic photoconductor No. 2-5 according to the present invention was prepared.

COMPARATIVE EXAMPLE 2-1

Example 2-3 was repeated except that 1,12-dodecanediol employed in the formulation of charge generation layer coating liquid in Example 2-1 was replaced by polyvinyl butyral (Trademark "XYHL" made by Union Carbide Japan K.K.), whereby a comparative electrophotographic photoconductor No. 2-1 was prepared.

By use of a Paper Analyzer (Kawaguchi Electro Works, Model SP-428), each of the electrophotographic photoconductors No. 2-1 ~No. 2-5 and comparative photoconductor No. 2-1 was negatively charged in the dark under application of −6 kV of corona charge for 20 seconds. During the corona charge application, the surface potential V (volts) of the photoconductor was measured 2 seconds after the initiation of the charging of the photoconductor by the corona charge. The photoconductor was then allowed to stand in the dark without applying any charge thereto until the surface potential of the photoconductor became −b 800V. At this moment, the photoconductor was illuminated by a tungsten lamp, so that the exposures S(lux·sec.) required for reducing the surface potential to −400V by the light exposure was measured.

Each of the above photoconductors was exposed to the light of 100,000 lux·sec. by use of a tungsten lamp with a color temperature of 2856° K. and was then subjected to the same charging and exposing process as mentioned above, so that the corresponding surface potential V' (V) and exposure S' (lux·sec.) of the photoconductor was measured. The results are shown in Table 3.

TABLE 3

| | Charge Generation Layer Azo Pigment No./Aliphatic Alcohol | Before Fatigue V (Volts) | Before Fatigue S (lux · sec) | After Fatigue V' (Volts) | After Fatigue S' (lux · sec) |
|---|---|---|---|---|---|
| Example 2-1 | Azo Pigment No. 1/ 1,12-dodocanediol: 4/1 | −837 | 0.48 | −760 | 0.47 |
| Example 2-2 | Azo Pigment No. 1/ 1,12-dodecanediol: 4/1 | −932 | 0.64 | −920 | 0.64 |
| Example 2-3 | Azo Pigment No. 1/ propylene glycol: 8/1 | −790 | 0.50 | −769 | 0.48 |
| Example 2-4 | Azo Pigment No. 1/ Propylene glycol/Polyvinyl butyral = 1/1: 4/1 | −891 | 0.60 | −845 | 0.59 |

TABLE 3-continued

| | Charge Generation Layer Azo Pigment No./Aliphatic Alcohol | Before Fatigue V (Volts) | Before Fatigue S (lux · sec) | After Fatigue V' (Volts) | After Fatigue S' (lux · sec) |
|---|---|---|---|---|---|
| Example 2-5 | Azo Pigment No. 1/ 1,12-dodecanediol: 4/1 | −966 | 0.65 | −950 | 0.65 |
| Comp. Ex. 2-1 | Azo Pigment No. 1/ Polyvinyl Butyral: 4/1 | −960 | 0.67 | −622 | 0.63 |

EXAMPLE 3-1

[Preparation of Charge Generation Layer Coating Liquid]

A mixture of . 5 parts by weight of Azo Pigment (Pigment No. 1 in Table 1) and 160 parts by weight of a cyclohexanone solution containing 0.78 wt. % of dibenzo-18-crown-6-ether was dispersed in a ball mill for 72 hours, whereby a pigment dispersion was prepared. To 100 parts by weight of the thus prepared pigment dispersion, 90 parts by weight of methyl ethyl ketone were added with stirring, so that a charge generation layer coating liquid was prepared. [Preparation of Charge Transport Layer Coating Liquid]

A mixture of the following components was mixed and dispersed, whereby a charge transport layer coating liquid was prepared:

| | Parts by Weight |
|---|---|
| α-phenylstilbene type charge transporting material of the following formula: | 100 |

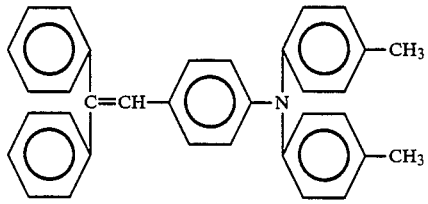

| | |
|---|---|
| Polycarbonate (Trademark "Panlite C-1400" made by Teijin Limited) | 100 |
| Silicone oil (Trademark "KF 50" made by Shin-Etsu Chemical Co., Ltd.) | 0.1 |
| Tetrahydrofuran | 800 |

The thus prepared charge generation layer coating liquid was coated by a doctor blade on an Al-deposited polyester film substrate formed by vacuum deposition having a thickness of 75 μm, and dried at 120° C. for 10 minutes so that a charge generation layer having a thickness of about 0.2 μm was formed on the film.

On the charge generation layer, the above prepared charge transport layer coating liquid was coated by a doctor blade and dried at 120° C. for 20 minutes, so that a charge transport layer having a thickness of about 20 μm was formed on the charge generation layer, whereby an electrophotographic photoconductor No. 3-1 according to the present invention was prepared.

EXAMPLE 3-2

The same charge transport layer coating liquid as that employed in Example 3-1 was coated by a doctor blade on a 75 μm thick Al-deposited polyester film substrate formed by vacuum deposition and dried, so that a charge transport layer having a thickness of about 20 μm was formed on the polyester film substrate.

On the thus prepared charge transport layer, the same charge generation layer coating liquid as that employed in Example 3-1 was coated by spray coating, and dried at 120° C. for 30 minutes, so that a charge generation layer having a thickness of about 0.2 um was formed on the charge transport layer, whereby an electrophotographic photoconductor No. 3-2 according to the present invention was prepared.

EXAMPLE 3-3

Example 3-1 was repeated except that Azo Pigment No. 1 and the cyclohexanone solution containing 0.78 wt. % of dibenzo-18-crown-6-ether alcohol in the formulation of the charge generation layer coating liquid in Example 3-1 were respectively replaced by Azo Pigment No. 39 in Table 1 and a cyclohexanone solution containing 0.156 wt. % of dicyclohexano-24-crown-8-ether, whereby an electrophotographic photoconductor No. 3-3 according to the present invention was prepared.

EXAMPLE 3-4

Example 3-3 was repeated except that 90 parts by weight of methyl ethyl ketone employed in the formulation of the charge generation layer coating liquid in Example 3-3 was replaced by 90 parts by weight of a methyl ethyl ketone solution containing 0.43 wt. % of polyvinyl butyral (Trademark "XYHL" made by Union Carbide Japan K.K.), whereby an electrophotographic photoconductor No. 3-4 according to the present invention was prepared.

EXAMPLE 3-5

A mixture of 8 parts by weight of finely-divided tin oxide particles containing 10 wt. % of antimony oxide, 5 parts by weight of titanium oxide white pigment and 68 parts by weight of a methyl ethyl ketone solution containing 12 wt. % of polyvinyl butyral (Trademark "BL-1" made by Sekisui Chemical Co., Ltd.) was dispersed in a ball mill for 72 hours. To this mixture, 47 parts by weight of methyl ethyl ketone were added, and the mixture was further dispersed for 48 hours. To 80 parts by weight of this dispersion, 8 parts by weight of a methyl ethyl ketone solution containing 20 wt. % of tolylene diisocyanate were added with stirring, whereby a light-scattering intermediate layer coating liquid was prepared.

The thus prepared light-scattering intermediate layer coating liquid was coated by a doctor blade on a 75 μm thick Al-deposited polyester film substrate formed by vacuum deposition and dried at 120° C. for 30 minutes, so that the coated liquid was thermally set, whereby a light-scattering intermediate layer having a thickness of about 2.5 μm was formed.

Then the same charge generation layer in Example 3-1 except that Azo Pigment No. 1 in Example 3-1 was replaced by Azo Pigment No. 39, and the same charge transport layer employed in Example 3-1 were successively formed on the above light-scattering intermediate layer, whereby an electrophotographic photoconductor No. 3-5 according to the present invention was prepared.

COMPARATIVE EXAMPLE 3-1

Example 3-1 was repeated except that the crown ether employed in the formulation of the charge generation layer coating liquid Example 3-1 was replaced by polyvinyl butyral (Trademark "XYHL" made by Union Carbide Japan K.K.), whereby a comparative electrophotographic photoconductor No. 3-1 was prepared.

COMPARATIVE EXAMPLE 3-2

Example 3-2 was repeated except that the crown ether employed in the formulation of the charge generation layer coating liquid in Example 3-2 was replaced by polyvinyl butyral (Trademark "XYHL" made by Union Carbide Japan K.K.), whereby a comparative electrophotographic photoconductor No. 3-2 was prepared.

COMPARATIVE EXAMPLE 3-3

Example 3-1 was repeated except that the cyclohexanone solution containing 0.78 wt. % of dibenzo-18-crown-6-ether employed in the formulation of the charge generation layer coating liquid in Example 3-1 was replaced by a cyclohexanone solution containing 5.58 wt. % of polyvinyl butyral (Trademark "XYHL" made by Union Carbide Japan K.K.), whereby a comparative electrophotographic photoconductor No. 3-3 was prepared.

By use of a Paper Analyzer (Kawaguchi Electro Works, Model SP-428), each of the electrophotographic photoconductors No. 3-1 and No. 3-3~No. 3-5 and comparative photoconductor No. 3-1 was negatively charged in the dark under application of −6 kV of corona charge for 20 seconds. During the corona charge application, the surface potential V (volts) of the photoconductor was measured 2 seconds after the initiation of the charging of the photoconductor by the corona charge. The photoconductor was then allowed to stand in the dark without applying any charge thereto until the surface potential of the photoconductor became −800V. At this moment, the photoconductor was illuminated by a tungsten lamp, so that the exposure S(lux·sec.) required for reducing the surface potential to −400V by the light exposure was measured.

The electrophotographic photoconductor No. 3-2 and comparative electrophotographic photoconductor No. 3-2 were positively charged in the dark under application of +7 kV of corona charge for 20 seconds. During the corona charge application, the surface potential V (volts) of each photoconductor was measured 2 seconds after the initiation of the charging of the photoconductor by the corona charge. Each photoconductor was then allowed to stand in the dark without applying any charge thereto until the surface potential of the photoconductor became +800V. At this moment, the photoconductor was illuminated by a tungsten lamp, so that the exposure S(lux·sec.) required for reducing the surface potential to +80V by the light exposure was measured.

Each of the above photoconductors was exposed to the light of 100,000 lux sec by use of a tungsten lamp with a color temperature of 2856° K. and was then subjected to the same charging and exposing process as mentioned above, so that the corresponding surface potential V′ (V) and exposure S′ (lux·sec.) of the photoconductor was measured. The results are shown in Table 4.

TABLE 4

| | Charge Generation Layer Azo Pigment No./Crown Ether | Before Fatigue V (Volts) | Before Fatigue S (lux · sec) | After Fatigue V′ (Volts) | After Fatigue S′ (lux · sec) |
|---|---|---|---|---|---|
| Example 3-1 | Azo Pigment No. 1/ dibenzo-18-crown-ether: 4/1 | −914 | 0.48 | −848 | 0.48 |
| Example 3-2 | Azo Pigment No. 1/ dibenzo-18-crown-ether: 4/1 | +901 | 0.49 | +867 | 0.47 |
| Example 3-3 | Azo Pigment No. 39/ dicyclohexano-24-crown-8-ether: 8/1 | −851 | 0.26 | −789 | 0.26 |
| Example 3-4 | Azo Pigment No. 39/ dicyclohexano-24-crown-8-ether/ Polyvinyl Butyral = 1/1: 4/1 | −862 | 0.30 | −820 | 0.30 |
| Example 3-5 | Azo Pigment No. 39/ dibenzo-18-crown-ether: 4/1 | −904 | 0.33 | −886 | 0.34 |
| Comp. Ex. 3-1 | Azo Pigment No. 1/ Polyvinyl Butyral: 4/1 | −958 | 0.63 | −602 | 0.57 |
| Comp. Ex. 3-2 | Azo Pigment No. 1/ Polyvinyl Butyral: 4/1 | +806 | 0.52 | +593 | 0.51 |

EXAMPLE 4-1

[Preparation of Charge Generation Layer Coating Liquid]

A mixture of the following components was dispersed in a ball mill, whereby a charge generation layer coating liquid was prepared:

| | Parts by Weight |
|---|---|
| Pigment No. 6 in Table 1 | 3 |
| Polyvinyl butyral (Trademark "Denka Butyral #4000-1" made by Denki Kagaku Kogyo K.K.) | 0.5 |
| Tetrahydrofuran | 150 |
| Ethyl cellosolve | 150 |

The thus prepared charge generation layer coating liquid was coated on an Al-deposited polyethylene terephthalate film by a doctor blade and dried, whereby a charge generation layer having a thickness of 0.2 μm was formed on the polyethylene terephthalate film.

[Preparation of Charge Transport Layer Coating Liquid ]

A mixture of the following components was dispersed in a ball mill, whereby a charge transport layer coating liquid was prepared:

| | Parts by Weight |
|---|---|
| 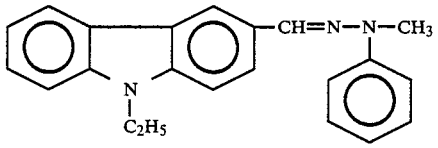 | 90 |
| (Charge transporting material) | |
| Polycarbonate (Trademark "Panlite L-1250" made by Teijin Limited.) | 100 |
| Dodecyl alcohol | 3 |
| Tetrahydrofuran | 800 |

The thus prepared charge transport layer coating liquid was coated on the above formed charge generation layer by a doctor blade and dried, whereby a charge transport layer having a thickness of 20 μm was formed on the charge generation layer. Thus, an electrophotographic photoconductor No. 4-1 was prepared.

COMPARATIVE EXAMPLE 4-1

Example 4-1 was repeated except that dodecyl alcohol was eliminated from the formulation of the charge transport layer coating liquid in Example 4-1, whereby a comparative electrophotographic photoconductor No. 4-1 was prepared.

EXAMPLE 4-2

Example 4-1 was repeated except that the charge transport layer coating liquid employed in Example 4-1 was replaced by the following charge transport layer coating liquid, whereby an electrophotographic photoconductor No. 4-2 according to the present invention was prepared:

| | Parts by Weight |
|---|---|
| 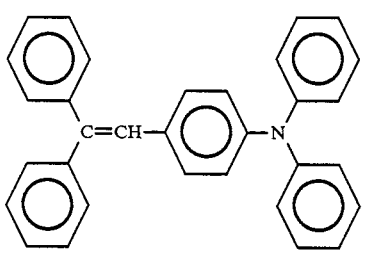 | 80 |
| (Charge transporting material) | |
| Polycarbonate | 100 |
| 1,8-octanediol | 2 |
| Tetrahydrofuran | 750 |

COMPARATIVE EXAMPLE 4-2

Example 4-2 was repeated except that 1,8-octanediol was eliminated from the formulation of the charge transport layer coating liquid in Example 4-2, whereby a comparative electrophotographic photoconductor No. 4-2 was prepared.

EXAMPLE 4-3

[Preparation of Intermediate Layer Coating Liquid]

A mixture of the following components was dispersed, whereby an intermediate layer coating liquid was prepared:

| | Parts by Weight |
|---|---|
| 25% aqueous solution of water-soluble polyvinyl butyral (Trademark "S-Lec W-201" made by Sekisui Chemical Co., Ltd.) | 50 |
| Water | 150 |
| Methanol | 200 |

[Preparation of Charge Generation Layer Coating Liquid]

A mixture of the following components was mixed and dispersed, whereby a charge generation layer coating liquid was prepared:

| | Parts by Weight |
|---|---|
| Pigment No. 39 in Table 1 | 3 |
| Cyclohexanone | 200 |
| Tetrahydrofuran | 100 |

[Preparation of Charge Transport Layer Coating Liquid]

A mixture of the following components was mixed and dispersed, whereby a charge transporting layer coating liquid was prepared:

| | Parts by Weight |
|---|---|
| α-phenylstilbene type charge transporting material of the following formula: 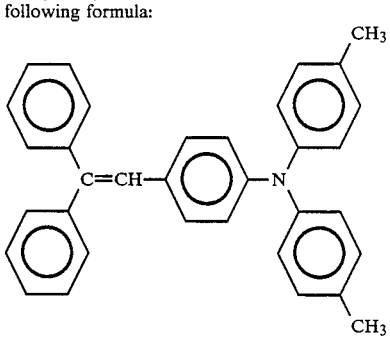 | 80 |
| Polycarbonate (Trademark "Panlite K-1300" by Teijin Kasei Co., Ltd.) | 100 |
| 1-eicosanol | 2 |
| Methylene chloride | 800 |

The above prepared intermediate layer coating liquid was coated on a 0.2 mm thick aluminum plate by immerse coating and then dried, whereby an intermediate layer having a thickness of 0.3 μm was formed on the aluminum plate.

The charge generation layer coating liquid was then coated on the above formed intermediate layer and dried, whereby a charge generation layer having a thickness of 0.3 μm was formed on the intermediate layer. In the same manner, the charge transport layer having a thickness of 0.2 μm was formed on the charge generation layer, whereby an electrophotographic photoconductor No. 4-3 was prepared.

COMPARATIVE EXAMPLE 4-3

Example 4-3 was repeated except that 1-eicosanol was eliminated from the formulation of the charge transport layer coating liquid in Example 4-3, whereby a comparative electrophotographic photoconductor No. 4-3 was prepared.

EXAMPLE 4—4

Example 4-3 was repeated except that the charge transport layer coating liquid employed in Example 4-3 was replaced by the following charge transport layer coating liquid, whereby an electrophotographic photoconductor No. 4—4 according to the present invention was prepared:

| | Parts by Weight |
|---|---|
| 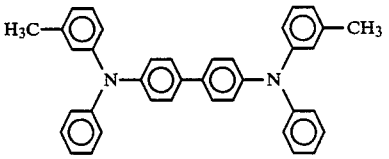 | 90 |
| (Charge transporting material) | |
| Polyarylate (Trademark "U-100" made by Unitika Ltd.) | 100 |
| 2,5-hexanediol | 5 |
| Methylene chloride | 800 |

COMPARATIVE EXAMPLE 4—4

Example 4—4 was repeated except that 2,5-hexanediol was eliminated from the formulation of the charge transport layer coating liquid in Example 4-3, whereby a comparative electrophotographic photoconductor No. 4—4 was prepared.

EXAMPLE 4-5

[Preparation of Charge Transport Layer Coating Liquid]

A mixture of the following components was dispersed in a ball mill, whereby a charge transport layer coating liquid was prepared:

| | Parts by Weight |
|---|---|
| 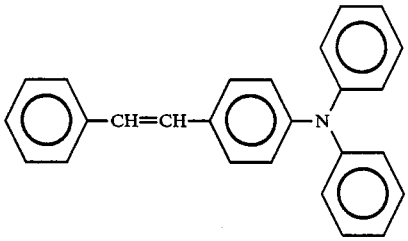 | 40 |
| (Charge transporting material) | |
| 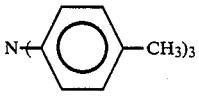 | 40 |

-continued

| | Parts by Weight |
|---|---|
| Polycarbonate (Trademark "Panlite C-1400" made by Teijin Kasei Co., Ltd.) | 100 |
| Hexadecyl alcohol | 4 |
| Tetrahydrofuran | 800 |

The above charge transport layer coating liquid was coated on the same Al-deposited polyethylene terephthalate film by a doctor blade and dried, whereby a charge transport layer having a thickness of 20 ? m was formed on the polyethylene terephthalate film.

[Preparation of Charge Generation Layer Coating Liquid]

A mixture of the following components was mixed and dispersed, whereby a charge generation layer coating liquid was prepared:

| | Parts by Weight |
|---|---|
| Pigment No. 47 in Table 1 | 3 |
| Polyester (Trademark "Vylon 200" made by Toyobo Co., Ltd.) | 2 |
| Cyclohexanone | 200 |
| 2-butanone | 100 |

The above prepared charge generation layer coating liquid was then coated on the above formed charge transport layer and dried, whereby a charge generation layer having a thickness of 0.3 μm was formed on the charge transport layer, whereby an electrophotographic photoconductor No. 4-5 according to the present invention was prepared.

COMPARATIVE EXAMPLE 4-5

Example 4-5 was repeated except that hexadecyl was eliminated from the formulation of the charge transport layer coating liquid in Example 4-5, whereby a comparative electrophotographic photoconductor No. 4-5 was prepared.

EXAMPLE 4-6

[Preparation of Intermediate Layer Coating Liquid]

A mixture of the following components was dispersed, whereby an intermediate layer coating liquid was prepared:

| | Parts by Weight |
|---|---|
| Alcohol-soluble Nylon (Trademark "Amilan CM-8000" made by Toray Industries, Inc.) | 2 |
| Methanol | 150 |
| Isopropyl alcohol | 100 |

[Preparation of Charge Transport Layer Coating Liquid]

A mixture of the following components was dispersed in a ball mill, whereby a charge transport layer coating liquid was prepared:

| | Parts by Weight |
|---|---|
| 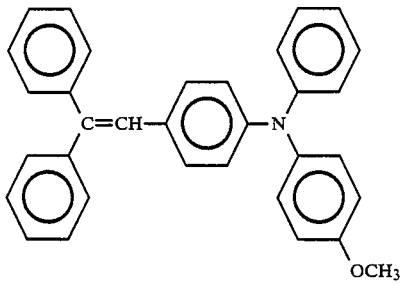 | 90 |
| (Charge transporting material) | |
| Polycarbonate ("Panlite K-1300) | 100 |
| 1,12-dodecanediol | 1 |
| Methylene chloride | 500 |
| Monochlorobenzene | 300 |

Preparation of Charge Generation Layer Coating Liquid]

A mixture of the following components was mixed and dispersed, whereby a charge generation layer coating liquid was prepared:

| | |
|---|---|
| Pigment No. 7 in Table 1 | 3 |
| Polyvinyl butyral (Trademark "S-Lec BL-1" made by Sekisui Chemical Co., Ltd.) | 2 |
| Toluylene-2,4-diisocyanate | 0.5 |
| Cyclohexanone | 300 |

The above prepared intermediate layer coating liquid was coated on a 0.2 mm thick aluminum plate and then dried, whereby an intermediate layer having a thickness of 0.5 μm was formed on the aluminum plate. The charge transport layer coating liquid was coated on the above intermediate layer and dried, whereby a charge transport layer having a thickness of 20 μm was formed on the intermediate layer. In the same manner, the charge generation layer having a thickness of 0.3 μm was formed on the charge generation layer , whereby an electrophotographic photoconductor No. 4-6 was prepared.

COMPARATIVE EXAMPLE 4-6

Example 4-6 was repeated except that 1,12-dodecanediol was eliminated from the formulation of the charge transport layer coating liquid, whereby a comparative electrophotographic photoconductor No. 4-6 was prepared.

By use of a Paper Analyzer (Kawaguchi Electro Works, Model SP-428), each of the electrophotographic photoconductors No. 4-1 through No. 4-4 and comparative photoconductors No. 4-1 through No. 4-4 was negatively charged in the dark under application of −5.5 kV of corona charge for 15 seconds. During the corona charge application, the surface potential V (volts) of the photoconductor was measured 2 seconds after the initiation of the charging of the photoconductor by the corona charge. The photoconductor was then allowed to stand in the dark without applying any charge thereto until the surface potential of the photoconductor became −800V. At this moment, the photoconductor was illuminated by a tungsten lamp of 5 lux, so that the exposure $E_{\frac{1}{2}}$ (lux·sec) required for reducing the surface potential to −400V by the light exposure was measured.

Each of the electrophotographic photoconductors No. 4-5 and No. 4-6 and comparative photoconductors No. 4-5 and No. 4-6 was positively charged in the dark under application of +6.0 kV of corona charge for 15 seconds. During the corona charge application, the surface potential V (volts) of the photoconductor was measured 2 seconds after the initiation of the charging of the photoconductor by the corona charge. Each of the photoconductors was then allowed to stand in the dark without applying any charge thereto until the surface potential of the photoconductor became +800V. At this moment, the photoconductor was illuminated by a tungsten lamp of 5 lux, so that the exposure $E_{\frac{1}{2}}$ (lux·sec.) required for reducing the surface potential to +400V by the light exposure was measured.

Each of the above photoconductors was exposed to the light of 100,000 lux sec by use of a tungsten lamp with a color temperature of 2856° K. and was then subjected to the same charging and exposing process as mentioned above, so that the corresponding surface potential V' (V) and exposure $E'_{\frac{1}{2}}$ (lux·sec.) of the photocon results are shown in Table 5.

TABLE 5

| | Charging Polarity | Before Fatigue $V_2$ (V) | Before Fatigue $E_{\frac{1}{2}}$ (lux · sec) | After Fatigue $V_2'$ (V) | After Fatigue $E'_{\frac{1}{2}}$ (lux · sec) |
|---|---|---|---|---|---|
| Example 4-1 | − | −763 | 0.78 | −733 | 0.78 |
| Comp. Ex. 4-1 | − | −657 | 0.78 | −450 | 0.75 |
| Example 4-2 | − | −772 | 0.78 | −745 | 0.77 |
| Comp. Ex. 4-2 | − | −624 | 0.77 | −436 | 0.73 |
| Example 4-3 | − | −904 | 0.49 | −871 | 0.47 |
| Comp. Ex. 4-3 | − | −875 | 0.48 | −509. | 0.46 |
| Example 4-4 | − | −872 | 0.49 | −860 | 0.47 |
| Comp. Ex. 4-4 | − | −810 | 0.49 | −152 | (*1) |
| Example 4-5 | + | +945 | 0.51 | +908 | 0.50 |
| Comp. Ex. 4-5 | + | +928 | 0.51 | +535 | 0.49 |
| Example 4-6 | + | +750 | 0.86 | +707 | 0.84 |
| Comp. Ex. 4-6 | + | +646 | 0.86 | +147 | (*2) |

(*1): Unable to charge the photoconductor to a surface potential of −800 V even after negative charge application for 15 seconds.

(*2): Unable to charge the photoconductor to a surface potential of +800 V even after positive charge application for 15 seconds.

EXAMPLE 5-1

Preparation of Charge Generation Layer Coating Liquid]

A mixture of the following components was dispersed in a ball mill, whereby a charge generation layer coating liquid was prepared:

| | Parts by Weight |
|---|---|
| Pigment No. 6 in Table 1 | 3 |
| Polyvinyl butyral (Trademark "Denka Butyral #4000-1" made by Denki Kagaku Kogyo K.K.) | 0.5 |
| Tetrahydrofuran | 150 |
| Ethyl cellosolve | 150 |

The thus prepared charge generation layer coating liquid was coated on an Al-deposited polyethylene terephthalate film by a doctor blade and dried, whereby a charge generation layer having a thickness of 0.2 μm was formed on the polyethylene terephthalate film.

Preparation of Charge Transport Layer Coating Liquid]

A mixture of the following components was dispersed in a ball mill, whereby a charge transport layer coating liquid was prepared:

| | Parts By Weight |
|---|---|
| 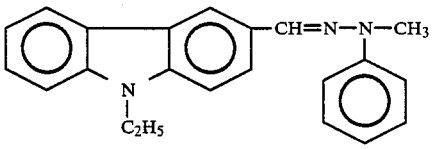 | 90 |
| (Charge transporting material) | |
| Polycarbonate (Trademark "Panlite L-1250" made by Teijin Kasei Co., Ltd.) | 100 |
| Polyethylene glycol (Trademark "PEG 6000S" made by Sanyo Chemical Industries, Ltd.) | 2 |
| Tetrahydrofuran | 800 |

The thus prepared charge transport layer coating liquid was coated on the above formed charge generation layer by a doctor blade and dried, whereby a charge transport layer having a thickness of 20 μm was formed on the charge generation layer. Thus, an electrophotographic photoconductor No. 5-1 was prepared.

COMPARATIVE EXAMPLE 5-1

Example 5-1 was repeated except that polyethylene glycol was eliminated from the formulation of the charge transport layer coating liquid in Example 5-1, whereby a comparative electrophotographic photoconductor No. 5-1 was prepared.

EXAMPLE 5-2

Example 5-1 was repeated except that the charge transport layer coating liquid employed in Example 5-1 was replaced by the following charge transport layer coating liquid, whereby an electrophotographic photoconductor No. 5-2 according to the present invention was prepared:

| | Parts by Weight |
|---|---|
| 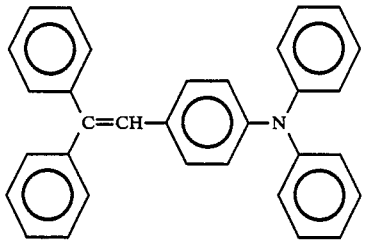 | 80 |
| (Charge transporting material) | |
| Polycarbonate | 100 |
| Polypropylene glycol (having an average molecular weight of 4000, made by Wako Pure Chemical Industries, Ltd.) | 3 |
| Tetrahydrofuran | 750 |

COMPARATIVE EXAMPLE 5-2

Example 4-2 was repeated except that polypropylene glycol was eliminated from the formulation of the charge transport layer coating liquid in Example 5-2, whereby a comparative electrophotographic photoconductor No. 5-2 was prepared.

EXAMPLE 5-3

[Preparation of Intermediate Layer Coating Liquid]

A mixture of the following components was dispersed, whereby an intermediate layer coating liquid was prepared:

| | Parts by Weight |
|---|---|
| 5% aqueous solution of water-soluble polyvinyl butyral (Trademark "S-Lec" made by Sekisui Chemical Co., Ltd.) | 50 |
| Water | 150 |
| Methanol | 200 |

[Preparation of Charge Generation Layer Coating Liquid]

A mixture of the following components was mixed and dispersed, whereby a charge generation layer coating liquid was prepared:

| | Parts by Weight |
|---|---|
| Pigment No. 39 in Table 1 | 3 |
| Cyclohexanone | 200 |
| Tetrahydrofuran | 100 |

[Preparation of Charge Transport Layer Coating Liquid]

A mixture of the following components was mixed and dispersed, whereby a charge transporting layer coating liquid was prepared:

| | Parts by Weight |
|---|---|
| 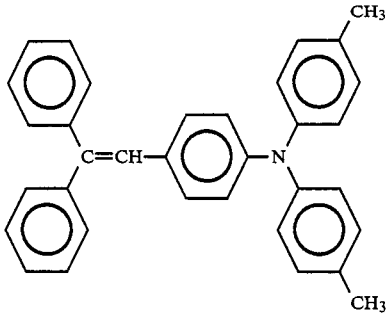 | 80 |
| (Charge transporting material) | |
| Polycarbonate (Trademark "Panlite K-1300" by Teijin Kasei Co., Ltd.) | 100 |
| Polybutylene glycol (Trademark "Terathane 2900" made by Du Pont Japan Ltd.) | 2 |
| Methylene chloride | 800 |

The above prepared intermediate layer coating liquid was coated on a 0.2 mm thick aluminum plate by immerse coating and then dried, whereby an intermediate layer having a thickness of 0.3 μm was formed on the aluminum plate.

The charge generation layer coating liquid was then coated on the above formed intermediate layer and dried, whereby a charge generation layer having a thickness of 0.2 μm was formed on the intermediate layer. In the same manner, the charge transport layer having a thickness of 18 μm was formed on the charge generation layer, whereby an electrophotographic photoconductor No. 5-3 was prepared.

COMPARATIVE EXAMPLE 5-3

Example 5-3 was repeated except that polybutylene glycol was eliminated from the formulation of the charge transport layer coating liquid in Example 5-3, whereby a comparative electrophotographic photoconductor No. 5-3 was prepared.

EXAMPLE 5-4

Example 5-3 was repeated except that the charge transport layer coating liquid employed in Example 5-3 was replaced by the following charge transport layer coating liquid, whereby an electrophotographic photoconductor No. 5-4 according to the present invention was prepared:

| | Parts by Weight |
|---|---|
| 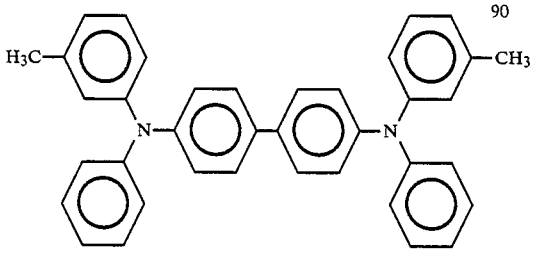 | 90 |
| (Charge transporting material) | |
| Polyarylate (Trademark "U-100" made by Unitika Ltd.) | 100 |
| Polyethylene oxide (Trademark "U-100" made by Seitetsu Kagaku Co., Ltd.) | 5 |
| Methylene chloride | 800 |

COMPARATIVE EXAMPLE 5-4

Example 5-4 was repeated except the polyethylene oxide was eliminated from the formulation of the charge transport layer coating liquid in Example 5-4, whereby a comparative electrophotographic phototconductor No. 5-4 was prepared.

EXAMPLE 5-5

A mixture of the following components was dispersed in a ball mill, whereby a charge transport layer coating liquid was prepared:

| | Parts by Weight |
|---|---|
| 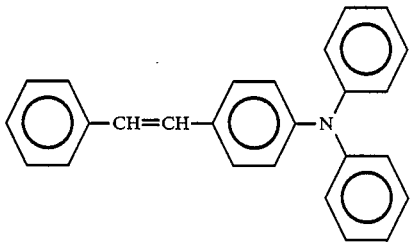 | 40 |
| (Charge transporting material) | |
| 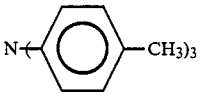 | 40 |
| Polycarbonate (Trademark "Panlite L-1250" made by Teijin Kasei Co., Ltd.) | 100 |
| Polyoxyethylene polyoxypropylene glycol (Trademark "Newpol PE68" made by Sanyo Chemical Industries, Ltd.: block copolymer) | 4 |
| Tetrahydrofuran | 800 |

The above charge transport layer coating liquid was coated on the same Al-deposited polyethylene terephthalate film by a doctor blade and dried, whereby a charge transport layer having a thickness of 20 μm was formed on the polyethylene terephthalate film. [Preparation of Charge Generation Layer Coating Liquid]

A mixture of the following components was mixed and dispersed, whereby a charge generation layer coating liquid was prepared:

| | Parts by Weight |
|---|---|
| Pigment No. 47 in Table 1 | 3 |
| Polyester (Trademark "Vylon 200" made by Toyobo Co., Ltd.) | 2 |
| Cyclohexanone | 200 |
| 2-butane | 100 |

The above prepared charge generation layer coating liquid was then coated on the above formed charge transport layer by spray coating and dried, whereby a charge generation layer having a thickness of 0.3 μm was formed on the charge transport layer, whereby an electrophotographic photoconductor no. 5-5 according to the present invention was prepared.

COMPARATIVE EXAMPLE 5-5

Example 5-5 was repeated except that polyoxyethylene polyoxypropylene glycol was eliminated from the formulation of the charge transport layer coating liquid in Example 5-5, whereby a comparative electrophotographic photoconductor No. 5-5 was prepared.

By use of a Paper Analyzer (Kawaguchi Electro Works, Model SP-428), each of the electrophotographic photoconductors No. 5-1 through No. 5-4 and comparative photoconductors No. 5-1 through No. 5-4 was negatively charged in the dark under application of −5.5 kV of corona charge for 15 seconds. During the corona charge application, the surface potential V (volts) of the photoconductor was measured 2 seconds after the initiation of the charging of the photoconductor by the corona charge. The photoconductor was then allowed to stand in the dark without applying any charge thereto until the surface potential of the photoconductor became −800V. At this moment, the photoconductor was illuminated by a tungsten lamp of 5 lux, so that the exposure $E_{\frac{1}{2}}$ (lux·sec.) required for reducing the surface potential to −400V by the light exposure was measured.

Each of the electrophotographic photoconductor No. 5-5 and comparative electrophotographic photoconductor No. 5-5 was positively charged in the dark under application of +6.0 kV of corona charge for 15 seconds. During the corona charge application, the surface potential V (volts) of the photoconductor was measured 2 seconds after the initiation of the charging of the photoconductor by the corona charge. Each of the photoconductors was then allowed to stand in the dark without applying any charge thereto until the surface potential of the photoconductor became +800V. At this moment, the photoconductor was illuminated by a tungsten so that the exposure El/2 (lux·sec.) required lamp of 5 lux, so that the exposure $E_{\frac{1}{2}}$ (lux·sec) required for reducing the surface potential to +400V by the light exposure was measured.

Each of the above photoconductors was exposed to the light of 100,000 lux sec by use of a tungsten lamp with a color temperature of 2856° K. and was then subjected to the same charging and exposing process as mentioned above, so that the corresponding surface potential V′ (V) and exposure $E'_{\frac{1}{2}}$ (lux·sec.) of the photoconductor was measured. The results are shown in Table 6.

TABLE 6

| | Charging Polarity | Before Fatigue $V_2$ (V) | Before Fatigue $E_{\frac{1}{2}}$ (lux · sec) | After Fatigue $V_2'$ (V) | After Fatigue $E'_{\frac{1}{2}}$ (lux · sec) |
|---|---|---|---|---|---|
| Example 5-1 | − | −768 | 0.80 | −761 | 0.79 |
| Comp. Ex. 5-1 | − | −657 | 0.78 | −450 | 0.75 |
| Example 5-2 | − | −783 | 0.78 | −788 | 0.79 |
| Comp. Ex. 5-2 | − | −624 | 0.77 | −436 | 0.73 |
| Example 5-3 | − | −922 | 0.50 | −920 | 0.49 |
| Comp. Ex. 5-3 | − | −875 | 0.48 | −509 | 0.52 |
| Example 5-4 | − | −906 | 0.51 | −894 | 0.52 |
| Comp. Ex. 5-4 | − | −810 | 0.49 | −152 | (*1) |
| Example 5-5 | + | +981 | 0.51 | +988 | 0.53 |
| Comp. Ex. 5-5 | + | +928 | 0.51 | +535 | 0.49 |

(*1): Unable to charge the photoconductor to a surface potential of −800 V even after negative charge application for 15 seconds.
(*2): Unable to charge the photoconductor to a surface potential of +800 V even after positive charge application for 15 seconds.

EXAMPLE 6-1

[Preparation of Charge Generation Layer Coating Liquid]

A mixture of the following components was dispersed in a ball mill, whereby a charge generation layer coating liquid was prepared:

| | Parts by Weight |
|---|---|
| Pigment No. 6 in Table 1 | 3 |
| Polyvinyl butyral (Trademark "Denka Butyral #4000-1" made by Denki Kagaku Kogyo K.K.) | 0.5 |
| Tetrahydrofuran | 150 |
| Ethyl cellosolve | 150 |

The thus prepared charge generation layer coating liquid was coated on an Al-deposited polyethylene terephthalate film by a doctor blade and dried, whereby a charge generation layer having a thickness of 0.2 μm was formed on the polyethylene terephthalate film.

[Preparation of Charge Transport Layer Coating Liquid]

A mixture of the following components was dispersed in a ball mill, whereby a charge transport layer coating liquid was prepared:

| | Parts by Weight |
|---|---|
| 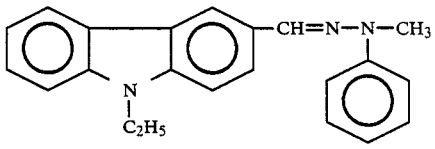 | 90 |
| (Charge transporting material) Polycarbonate (Trademark "Panlite L-1250" made by Teijin Kasei Co., Ltd.) | 100 |
| Polyethylene glycol monocarboxylic acid ester (Trademark "Ionet MS400" made by Sanyo Chemical Industries, Ltd.) | 3 |

-continued

| | Parts by Weight |
|---|---|
| Tetrahydrofuran | 800 |

The thus prepared charge transport layer coating liquid was coated on the above formed charge generation layer by a doctor blade and dried, whereby a charge transport layer having a thickness of 20 μm was formed on the charge generation layer. Thus, an electrophotographic photoconductor No. 6-1 was prepared.

COMPARATIVE EXAMPLE 6-1

Example 6-1 was repeated except that polyethylene glycol monocarboxylic acid ester was eliminated from the formulation of the charge transport layer coating liquid in Example 6-1, whereby a comparative electrophotographic photoconductor No. 6-1 was prepared.

EXAMPLE 6-2

Example 6-1 was repeated except that the charge transport layer coating liquid employed in Example 6-1 was replaced by the following charge transport layer coating liquid, whereby an electrophotographic photoconductor No. 6-2 according to the present invention was prepared:

| | Parts by Weight |
|---|---|
| 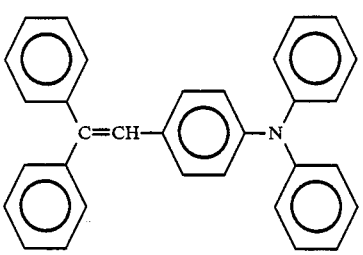 | 80 |
| (Charge transporting material) | |
| Polycarbonate | 100 |
| Polyethylene glycol dicarboxylic acid ester (Trademark "Ionet DL200" made by Sanyo Chemical Industries, Ltd.) | 2 |
| Tetrahydrofuran | 750 |

COMPARATIVE EXAMPLE 6-2

Example 6-2 was repeated except that polyethylene glycol dicarboxylic acid ester was eliminated from the formulation of the charge transport layer coating liquid in Example 6-2, whereby a comparative electrophotographic photoconductor No. 6-2 was prepared.

EXAMPLE 6-3

[Preparation of Intermediate Layer Coating Liquid]

A mixture of the following components was dispersed, whereby an intermediate layer coating liquid was prepared:

| | Parts by Weight |
|---|---|
| 25% aqueous solution of water-soluble polyvinyl butyral (Trademark "S-Lec W-201" made by Sekisui Chemical Co., Ltd.) | 50 |
| Water | 150 |
| Methanol | 200 |

-continued

[Preparation of Charge Generation Layer Coating Liquid]

A mixture of the following components was mixed and dispersed, whereby a charge generation layer coating liquid was prepared:

| | Parts by Weight |
|---|---|
| Pigment No. 39 in Table 1 | 3 |
| Cyclohexanone | 200 |
| Tetrahydrofuran | 100 |

[Preparation of Charge Transport Layer Coating Liquid]

A mixture of the following components was mixed and dispersed, whereby a charge transporting layer coating liquid was prepared:

| | Parts by Weight |
|---|---|
| 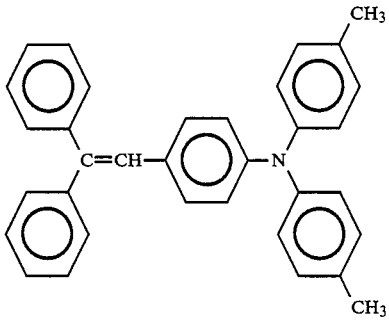 | 80 |
| (Charge transporting material) | |
| Polycarbonate (Trademark "Panlite K-1300" by Teijin Kasei Co., Ltd.) | 100 |
| Monolauric acid polyoxyethylene sorbitan (Trademark "Ionet T-20C" made by Sanyo Chemical Industries, Ltd.) | 2 |
| Methylene chloride | 800 |

The above prepared intermediate layer coating liquid was coated on a 0.2 mm thick aluminum plate and then dried, whereby an intermediate layer having a thickness of 0.3 μm was formed on the aluminum plate.

The charge generation layer coating liquid was then coated on the above formed intermediate layer and dried, whereby a charge generation layer having a thickness of 0.2 μm was formed on the intermediate layer. In the same manner, the charge transport layer having a thickness of 18 'm was formed on the charge generation layer, whereby an electrophotographic photoconductor No. 6-3 was prepared.

COMPARATIVE EXAMPLE 6-3

Example 6-3 was repeated except that monolauric acid polyoxyethylene sorbitan was eliminated from the formulation of the charge transport layer coating liquid in Example 6-3, whereby a comparative electrophotographic photoconductor No. 6-3 was prepared.

EXAMPLE 6-4

[Preparation of Intermediate Layer Coating Liquid]

A mixture of the following components was dispersed, whereby an intermediate layer coating liquid was prepared:

| | Parts by Weight |
|---|---|
| Alcohol-soluble Nylon (Trademark "Amilan CM-8000" made by Toray Industries, Inc.) | 2 |
| Methanol | 150 |
| Isopropyl alcohol | 100 |

[Preparation of Charge Transport Layer Coating Liquid]

A mixture of the following components was dispersed in a ball mill, whereby a charge transport layer coating liquid was prepared:

| | Parts by Weight |
|---|---|
| 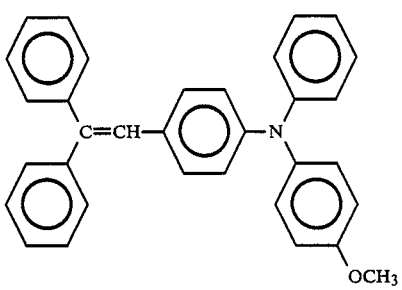 (Charge transporting material) | 90 |
| Polycarbonate ("Panlite K-1300" made by Teijin Kasei Co., Ltd.) | 100 |
| Mono-oleic acid polyoxyethylene sorbitan (Trademark "Ionet T-80C" made by Sanyo Chemical Industries, Ltd.) | 1 |
| Methylene chloride | 500 |
| Monochlorobenzene | 300 |

[Preparation of Charge Generation Layer Coating Liquid]

A mixture of the following components was mixed and dispersed, whereby a charge generation layer coating liquid was prepared:

| | Parts by Weight |
|---|---|
| Pigment No. 7 in Table 1 | 3 |
| Polyvinyl butyral (Trademark "S-Lec BL-1" made by Sekisui Chemical Co., Ltd.) | 2 |
| Toluylene-2,4-diisocyanate | 0.5 |
| Cyclohexanone | 300 |

The above prepared intermediate layer coating liquid was coated on a 0.2 mm thick aluminum plate by spray coating and then dried, whereby an intermediate layer having a thickness of 0.5 μm was formed on the aluminum plate. The charge transport layer coating liquid was coated on the above intermediate layer and dried, whereby a charge transport layer having a thickness of 20 μm was formed on generation layer having a thickness of 0.3 μm was formed on the charge generation layer, whereby an electrophotographic photoconductor No. 6-4 was prepared.

COMPARATIVE EXAMPLE 6-4

Example 6-4 was repeated except that mono-oleic acid polyoxyethylene sorbitan was eliminated from the formulation of the charge transport layer coating liquid, whereby a comparative electrophotographic photoconductor No. 6-4 was prepared.

By use of a Paper Analyzer (Kawaguchi Electro Works, Model SP-428), each of the electrophotographic photoconductors No. 6-1 through No. 6-3 and comparative photoconductors No. 6-1 through No. 6-3 was negatively charged in the dark under application of -5.5 kV of corona charge for 15 seconds. During the corona charge application, the surface potential V (volts) of the photoconductor was measured 2 seconds after the initiation of the charging of the photoconductor by the corona charge. The photoconductor was then allowed to stand in the dark without applying any charge thereto until the surface potential of the photoconductor became −800V. At this moment, the photoconductor was illuminated by a tungsten lamp of 5 lux, so that the exposure $E_{\frac{1}{2}}$ (lux.sec) required for reducing the surface potential to −400 V by the light exposure was measured.

The electrophotographic photoconductor No. 6-4 and comparative electrophotographic photoconductor No. 6-4 were positively charged in the dark under application of +6.0 kV of corona charge for 15 seconds. During the corona charge application, the surface potential V (volts) of each photoconductor was measured 2 seconds after the initiation of the charging of the photoconductor by the corona charge. Each of the photoconductors was then allowed to stand in the dark without applying any charge thereto until the surface potential of the photoconductor becomes +800V. At this moment, the photoconductor was illuminated by a tungsten lamp of 5 lux, so that the exposure $E_{\frac{1}{2}}$ (lux·sec) required for reducing the surface potential to +400 V by the light exposure was measured.

Each of the above photoconductors was exposed to the light of 10,000 lux·sec by use of a tungsten lamp with a color temperature of 2856° K. and was then subjected to the same charging and exposing process as mentioned above, so that the corresponding surface potential V' (V) and exposure $E'_{\frac{1}{2}}$ (lux·sec) of the photoconductor was measured. The results are shown in Table 7.

TABLE 7

| | Charging Polarity | Before Fatigue $V_2$ (V) | Before Fatigue $E_{\frac{1}{2}}$ (lux · sec) | After Fatigue $V_2'$(V) | After Fatigue $E'_{\frac{1}{2}}$ (lux · sec) |
|---|---|---|---|---|---|
| Example 6-1 | − | −741 | 0.78 | −719 | 0.77 |
| Comp. Ex. 6-1 | − | −657 | 0.78 | −450 | 0.75 |
| Example 6-2 | − | −708 | 0.77 | −701 | 0.75 |
| Comp. Ex. 6-2 | − | −624 | 0.77 | −436 | 0.73 |
| Example 6-3 | − | −930 | 0.49 | −943 | 0.50 |
| Comp. Ex. 6-3 | − | −875 | 0.48 | −509 | 0.46 |
| Example 6-4 | + | +825 | 0.87 | +810 | 0.85 |
| Comp. | | | | | |

TABLE 7-continued

| | Charging Polarity | Before Fatigue $V_2$ (V) | Before Fatigue $E_{\frac{1}{2}}$ (lux · sec) | After Fatigue $V_2'$(V) | After Fatigue $E'_{\frac{1}{2}}$ (lux · sec) |
|---|---|---|---|---|---|
| Ex. 6-4 | + | +646 | 0.86 | +147 | (*1) |

(*1): Unable to charge photoconductor to a surface potential of +800 V even after positive charge application for 15 seconds.

EXAMPLE 7-1

[Preparation of Charge Generation Layer Coating Liquid]

A mixture of the following components was dispersed in a ball mill, whereby a charge generation layer coating liquid was prepared:

| | Parts by Weight |
|---|---|
| Pigment No. 6 in Table 1 | 3 |
| Polyvinyl butyral (Trademark "Denka Butyral #4000-1" made by Denki Kagaku Kogyo K.K.) | 0.5 |
| Tetrahydrofuran | 150 |
| Ethyl cellosolve | 150 |

The thus prepared charge generation layer coating liquid was coated on an Al-deposited polyethylene terephthalate film by a doctor blade and dried, whereby a charge generation layer having a thickness of 0.2 μm was formed on the polyethylene terephthalate film.

[Preparation of Charge Transport Layer Coating Liquid]

A mixture of the following components was dispersed in a ball mill, whereby a charge transport layer coating liquid was prepared:

| | Parts by Weight |
|---|---|
| 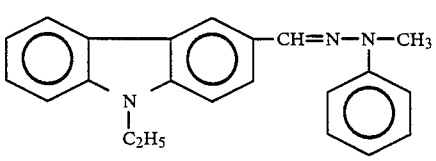 | 90 |
| (Charge transporting material) | |
| Polycarbonate (Trademark "Panlite L-1250" made by Teijin Kasei Co., Ltd.) | 100 |
| Polyethylene glycol monoether (Trademark "Emulmin L380" made by Sanyo Chemical Industries, Ltd.) | 3 |
| Tetrahydrofuran | 800 |

The thus prepared charge transport layer coating liquid was coated on the above formed charge generation layer by a doctor blade and dried, whereby a charge transport layer having a thickness of 20 μm was formed on the charge generation layer. Thus, an electrophotographic photoconductor No. 7-1 was prepared.

COMPARATIVE EXAMPLE 7-1

Example 7-1 was repeated except that polyethylene glycol monoether was eliminated from the formulation of the charge transport layer coating liquid in Example 7-1, whereby a comparative electrophotographic photoconductor No. 7-1 was prepared.

EXAMPLE 7-2

Example 7-1 was repeated except that the charge transport layer coating liquid employed in Example 7-1 was replaced by the following charge transport layer coating liquid, whereby an electrophotographic photoconductor No. 7-2 according to the present invention was prepared:

| | Parts by Weight |
|---|---|
| 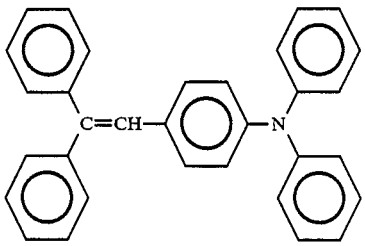 | 80 |
| (Charge transporting material) | |
| Polycarbonate | 100 |
| Polypropylene glycol monoether (Trademark "Newpol LB1800X" made by Sanyo Chemical Industries, Ltd.) | 2 |
| Tetrahydrofuran | 750 |

COMPARATIVE EXAMPLE 7-2

Example 7-2 was repeated except that polypropylene glycol monoether was eliminated from the formulation of the charge transport layer coating liquid in Example 7-2, whereby a comparative electrophotographic photoconductor No. 7-2 was prepared.

EXAMPLE 7-3

[Preparation of Intermediate Layer Coating Liquid]

A mixture of the following components was dispersed, whereby an intermediate layer coating liquid was prepared:

| | Parts by Weight |
|---|---|
| 25% aqueous solution of water-soluble polyvinyl butyral (Trademark "S-Leu W-201" made by Sekisui Chemical Co., Ltd.) | 50 |
| Water | 150 |
| Methanol | 200 |

[Preparation of Charge Generation Layer Coating Liquid]

A mixture of the following components was mixed and dispersed, whereby a charge generation layer coating liquid was prepared:

| | Parts by Weight |
|---|---|
| Pigment No. 39 in Table 1 | 3 |
| Cyclohexanone | 200 |
| Tetrahydrofuran | 100 |

[Preparation of Charge Transport Layer Coating Liquid]

A mixture of the following components was mixed and dispersed, whereby a charge transporting layer coating liquid was prepared:

| | Parts by Weight |
|---|---|
| 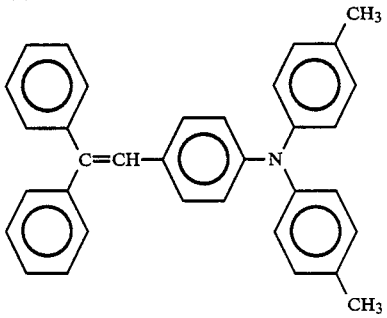 | 80 |
| (Charge transporting material) | |
| Polycarbonate (Trademark "Panlite K-1300" by Teijin Kasei Co., Ltd.) | 100 |
| Polyoxyethylene polyoxypropylene glycol monoether (Trademark "Newpol 50HB-2000" made by Sanyo Chemical Industries, Ltd.) | 2 |
| Methylene chloride | 800 |

The above prepared intermediate layer coating liquid was coated on a 0.2 mm thick aluminum plate and then dried, whereby an intermediate layer having a thickness of 0.3 μm was formed on the aluminum plate.

The charge generation layer coating liquid was then coated on the above formed intermediate layer and dried, whereby a charge generation layer having a thickness of 0.2 μm was formed on the intermediate layer. In the same manner, the charge transport layer having a thickness of 18 μm was formed on the charge generation layer, whereby an electrophotographic photoconductor No. 7-3 was prepared.

COMPARATIVE EXAMPLE 7-3

Example 7-3 was repeated except that polyoxyethylene polyoxpropylene glycol monoether was eliminated from the formulation of the charge transport layer coating liquid in Example 7-3, whereby a comparative electrophotographic photoconductor No. 7-3 was prepared.

EXAMPLE 7-4

A mixture of the following components was dispersed in a ball mill, whereby a charge transport layer coating liquid was prepared:

| | Parts by Weight |
|---|---|
| 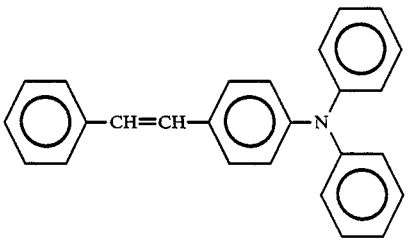 | 40 |
| (Charge transporting material) | |

-continued

| | Parts by Weight |
|---|---|
| 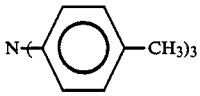 | 40 |
| Polycarbonate (Trademark "Panlite C-1400" made by Teijin Kasei Co., Ltd.) | 100 |
| Polypropylene glycol monoether (Trademark "Newpol LB65" made by Sanyo Chemical Industries, Ltd.) | 4 |
| Tetrahydrofuran | 800 |

The above charge transport layer coating liquid was coated on the same Al-deposited polyethylene terephthalate film by a doctor blade and dried, whereby a charge transport layer having a thickness of 20 μm was formed on the polyethylene terephthalate film.

[Preparation of Charge Generation Layer Coating Liquid]

A mixture of the following components was mixed and dispersed, whereby a charge generation layer coating liquid was prepared:

| | Parts by Weight |
|---|---|
| Pigment No. 47 in Table 1 | 3 |
| Polyester (Trademark "Vylon 200" made by Toyobo Co., Ltd.) | 2 |
| Cyclohexanone | 100 |
| 2-butanone | 200 |

The above prepared charge generation layer coating liquid was then coated on the above formed charge transport layer by spray coating and dried, whereby a charge generation layer having a thickness of 0.3 μm was formed on the charge transport layer, whereby an electrophotographic photoconductor No. 7-4 according to the present invention was prepared.

COMPARATIVE EXAMPLE 7-4

Example 7-4 was repeated except that polypropylene glycol monoether was eliminated from the formulation of the charge transport layer coating liquid in Example 7-4, whereby a comparative electrophotographic photoconductor No. 7-4 was prepared.

By use of a Paper Analyzer (Kawaguchi Electro Works, Model SP-428), each of the electrophotographic photoconductors No. 7-1 through No. 7-3 and comparative photoconductors No. 7-1 through No. 7-3 was negatively charged in the dark under application of −5.5 kV of corona charge for 15 seconds. During the corona charge application, the surface potential V (volts) of the photoconductor was measured 2 seconds after the initiation of the charging of the photoconductor by the corona charge. The photoconductor was then allowed to stand in the dark without applying any charge thereto until the surface potential of the photoconductor became −800V. At this moment, the photoconductor was illuminated by a tungsten lamp of 5 lux, so that the exposure $E_{\frac{1}{2}}$ (lux·sec) required for reducing the surface potential to −400V by the light exposure was measured.

Each of the electrophotographic photoconductor No. 7-5 and comparative photoconductor No. 7-5 was positively charged in the dark under application of +6.0 kV of corona charge for 15 seconds. During the corona charge application, the surface potential V (volts) of the photoconductor was measured 2 seconds after the initiation of the charging of the photoconductor by the corona charge. Each of the photoconductors was then allowed to stand in the dark without applying any charge thereto until the surface potential of the photoconductor became +800V. At this moment, the photoconductor was illuminated by a tungsten lamp of 5 lux, so that the exposure $E_{\frac{1}{2}}$ (lux·sec) required for reducing the surface potential to +400V by the light exposure was measured.

Each of the above photoconductors was exposed to the light of 100,000 lux.sec by use of a tungsten lamp with a color temperature of 2856° K. and was then subjected to the same charging and exposing process as mentioned above, so that the corresponding surface potential V' (V) and exposure $E'_{\frac{1}{2}}$ (lux·sec) of the photoconductor was measured. The results are shown in Table 8.

TABLE 8

| | Charging Polarity | Before Fatigue $V_2$ (V) | Before Fatigue $E_{\frac{1}{2}}$ (lux · sec) | After Fatigue $V_2'$ (V) | After Fatigue $E'_{\frac{1}{2}}$ (lux · sec) |
|---|---|---|---|---|---|
| Example 7-1 | − | −720 | 0.78 | −727 | 0.79 |
| Comp. Ex. 7-1 | − | −657 | 0.78 | −450 | 0.75 |
| Example 7-2 | − | −706 | 0.78 | −703 | 0.78 |
| Comp. Ex. 7-2 | − | −624 | 0.77 | −436 | 0.73 |
| Example 7-3 | − | −899 | 0.49 | −910 | 0.50 |
| Comp. Ex. 7-3 | − | −875 | 0.48 | −509 | 0.46 |
| Example 7-4 | + | +971 | 0.52 | +936 | 0.51 |
| Comp. Ex. 7-4 | + | +928 | 0.51 | +535 | 0.49 |

EXAMPLE 8-1

[Preparation of Charge Generation Layer Coating Liquid]

A mixture of the following components was dispersed in a ball mill, whereby a charge generation layer coating liquid was prepared:

| | Parts by Weight |
|---|---|
| Pigment No. 6 in Table 1 | 3 |
| Polyvinyl butyral (Trademark "Denka Butyral #4000-1" made by Denki Kagaku Kogyo K.K.) | 0.5 |
| Tetrahydrofuran | 150 |
| Ethyl cellosolve | 150 |

The thus prepared charge generation layer coating liquid was coated on an Al-deposited polyethylene terephthalate film by a doctor blade and dried, whereby a charge generation layer having a thickness of 0.2 μm was formed on the polyethylene terephthalate film.

[Preparation of Charge Transport Layer Coating Liquid]

A mixture of the following components was dispersed in a ball mill, whereby a charge transport layer coating liquid was prepared:

| | Parts by Weight |
|---|---|
| 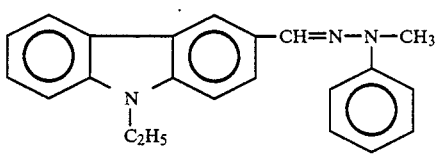 | 90 |
| (Charge transporting material) | |
| Polycarbonate (Trademark "Panlite L-1250" made by Teijin Kasei Co., Ltd.) | 100 |
| Dicyclohexano-18-crown ether | 3 |
| Tetrahydrofuran | 800 |

The thus prepared charge transport layer coating liquid was coated on the above formed charge generation layer by a doctor blade and dried, whereby a charge transport layer having a thickness of 20 μm was formed on the charge generation layer. Thus, an electrophotographic photoconductor No. 8-1 was prepared.

COMPARATIVE EXAMPLE 8-1

Example 8-1 was repeated except that crown ether was eliminated from the formulation of the charge transport layer coating liquid in Example 8-1, whereby a comparative electrophotographic photoconductor No. 8-1 was prepared.

EXAMPLE 8-2

Example 8-1 was repeated except that the charge transport layer coating liquid employed in Example 8-1 was replaced by the following charge transport layer coating liquid, whereby an electrophotographic photoconductor No. 8-2 according to the present invention was prepared:

| | Parts by Weight |
|---|---|
| 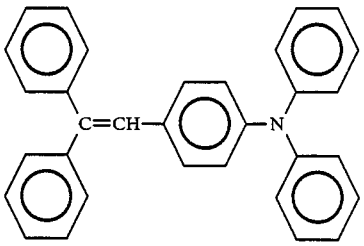 | 80 |
| (Charge transporting material) | |
| Polycarbonate | 100 |
| Dibenzo-24-crown-8-ether | 2 |
| Tetrahydrofuran | 750 |

COMPARATIVE EXAMPLE 8-2

Example 8-2 was repeated except that crown ether was eliminated from the formulation of the charge transport layer coating liquid in Example 8-2, whereby a comparative electrophotographic photoconductor No. 8-2 was prepared.

EXAMPLE 8-3

[Preparation of Intermediate Layer Coating Liquid]

A mixture of the following components was dispersed, whereby an intermediate layer coating liquid was prepared:

| | Parts by Weight |
|---|---|
| 25% aqueous solution of water-soluble polyvinyl butyral | 50 |
| Water | 150 |
| Methanol | 200 |

[Preparation of Charge Generation Layer Coating Liquid]

A mixture of the following components was mixed and dispersed, whereby a charge generation layer coating liquid was prepared:

| | Parts by Weight |
|---|---|
| Pigment No. 39 in Table 1 | 3 |
| Cyclohexanone | 200 |
| Tetrahydrofuran | 100 |

[Preparation of Charge Transport Layer Coating Liquid]

A mixture of the following components was mixed and dispersed, whereby a charge transporting layer coating liquid was prepared:

| | Parts by Weight |
|---|---|
| 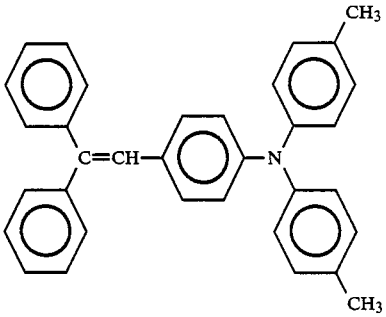 | |
| (Charge transporting material) | |
| Polycarbonate (Trademark "Panlite K-1300" by Teijin Kasei Co., Ltd.) | 100 |
| Dibenzo-18-crown-6-ether | 2 |
| Methylene chloride | 800 |

The above prepared intermediate layer coating liquid was coated on a 0.2 mm thick aluminum plate and then dried, whereby an intermediate layer having a thickness of 0.3 μm was formed on the aluminum plate.

The charge generation layer coating liquid was then coated on the above formed intermediate layer and dried, whereby a charge generation layer having a thickness of 0.2 μm was formed on the intermediate layer. In the same manner, the charge transport layer having a thickness of 18 μm was formed on the charge generation layer, whereby an electrophotographic photoconductor No. 8-3 was prepared.

COMPARATIVE EXAMPLE 8-3

Example 8-3 was repeated except that dibenzo-18-crown-6-ether was eliminated from the formulation of the charge transport layer coating liquid in Example 8-3, whereby a comparative electrophotographic photoconductor No. 8-3 was prepared.

EXAMPLE 8-4

Example 8-3 was repeated except that the charge transport layer coating liquid employed in Example 8-3 was replaced by the following charge transport layer coating liquid, whereby an electrophotographic photoconductor No. 8-4 according to the present invention was prepared:

| | Parts by Weight |
|---|---|
| 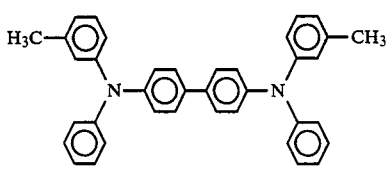 | 90 |
| (Charge transporting material) | |
| Polyarylate (Trademark "U-100" made by Unitika Ltd.) | 100 |
| Benzo-15-crown-5-ether | 5 |
| Methylene chloride | 800 |

COMPARATIVE EXAMPLE 8-4

Example 8-4 was repeated except that benzo-15-crown-5-ether was eliminated from the formulation of the charge transport layer coating liquid in Example 8-4, whereby a comparative electrophotographic photoconductor No. 8-4 was prepared.

EXAMPLE 8-5

[Preparation of Charge Transport Layer Coating Liquid]

A mixture of the following components was dispersed in a ball mill, whereby a charge transport layer coating liquid was prepared:

| | Parts by Weight |
|---|---|
| 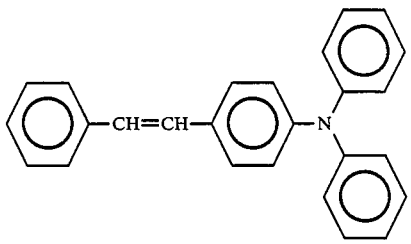 | 40 |
| (Charge transporting material) | |
| 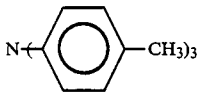 | 40 |
| Polycarbonate (Trademark "Panlite C-1400" made by Teijin Kasei Co., Ltd.) | 100 |
| Dicyclohexano-18-crown-6-ether | 4 |
| Tetrahydrofuran | 800 |

The above charge transport layer coating liquid wa coated on the same Al-deposited polyethylene terephthalate film by a doctor blade and dried, whereby a charge transport layer having a thickness of 20 μm was formed on the polyethylene terephthalate film.

[Preparation of Generation Layer Coating Liquid]

A mixture of the following components was mixed and dispersed, whereby a charge generation layer coating liquid was prepared:

| | Parts by Weight |
|---|---|
| Pigment No. 47 in Table 1 | 3 |
| Polyester (Trademark "Vylon 200" made by Toyobo Co., Ltd.) | 2 |
| Cyclohexanone | 200 |
| 2-butanone | 100 |

The above prepared charge generation layer coating liquid was then coated on the above formed charge transport layer by spray coating and dried, whereby a charge generation layer having a thickness of 0.3 μm was formed on the charge transport layer, whereby an electrophotographic photoconductor No. 8-5 according to the present invention was prepared.

COMPARATIVE EXAMPLE 8-5

Example 8-5 was repeated except that dicyclohexano-18-crown-6-ether was eliminated from the formulation of the charge transport layer coating liquid in Example 8-5, whereby a comparative electrophotographic photoconductor No. 8-5 was prepared.

EXAMPLE 8-6

[Preparation of Intermediate Layer Coating Liquid]

A mixture of the following components was dispersed, whereby an intermediate layer coating liquid was prepared:

| | Parts by Weight |
|---|---|
| Alcohol-soluble Nylon (Trademark "Amilan CM-8000" made by Toray Industries, Inc.) | 2 |
| Methanol | 150 |
| Isopropyl alcohol | 100 |

[Preparation of Charge Transport Layer Coating Liquid]

A mixture of the following components was dispersed in a ball mill, whereby a charge transport layer coating liquid was prepared:

| | Parts by Weight |
|---|---|
| 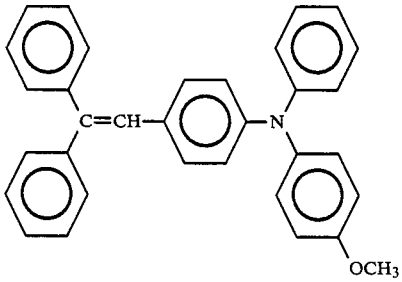 (Charge transporting material) | |
| Polycarbonate | 100 |
| Poly (dibenzo-18-crown ether) | 1 |

-continued

| | Parts by Weight |
|---|---|
| Methylene chloride | 500 |
| Monochlorobenzene | 300 |

[Preparation of Charge Generation Layer Coating Liquid]

A mixture of the following components was mixed and dispersed, whereby a charge generation layer coating liquid was prepared:

| | Parts by Weight |
|---|---|
| Pigment No. 7 in Table 1 | 3 |
| Polyvinyl butyral (Trademark "S-Lec BL-1" made by Sekisui Chemical Co., Ltd.) | 2 |
| Toluylene-2,4-diisocyanate | 0.5 |
| Cyclohexanone | 300 |

The above prepared intermediate layer coating liquid was coated on a 0.2 mm thick aluminum plate by spray coating and then dried, whereby an intermediate layer having a thickness of 0.5 μm was formed on the aluminum plate. The charge transport layer coating liquid was coated on the above intermediate layer and dried, whereby a charge transport layer having a thickness of 20 μm was formed on the intermediate layer. In the same manner, the charge generation layer having a thickness of 0.3 μm was formed on the charge generation layer, whereby an electrophotographic photoconductor No. 8-6 was prepared.

COMPARATIVE EXAMPLE 8-6

Example 8-6 was repeated except that poly (dibenzo-18-crown ether) was eliminated from the formulation of the charge transport layer coating liquid, whereby a comparative electrophotographic photoconductor No. 8-6 was prepared.

By use of a Paper Analyzer (Kawaguchi Electro Works, Model SP-428), each of the electrophotographic photoconductors No. 8-1 through No. 8-4 and comparative photoconductors No. 8-1 through No. 8-4 was negatively charged in the dark under application of −5.5 kV of corona charge for 15 seconds. During the corona charge application, the surface potential V (volts) of the photoconductor was measured 2 seconds after the initiation of the charging of the photoconductor by the corona charge. The photoconductor was then allowed to stand in the dark without applying any charge thereto until the surface potential of the photoconductor became −800V. At this moment, the photoconductor was illuminated by a tungsten lamp of 5 lux, so that the exposure $E_{\frac{1}{2}}$ (lux·sec) required for reducing the surface potential to −400V by the light exposure was measured.

Each of the electrophotographic photoconductor No. 8-5 and comparative photoconductors No. 8-5 was positively charged in the dark under application of +6.0 kV of corona charge for 15 seconds. During the corona charge application, the surface potential V (volts) of the photoconductor was measured 2 seconds after the initiation of the charging of the photoconductor by the corona charge. Each of the photoconductors was then allowed to stand in the dark without applying any charge thereto until the surface potential of the photoconductor became +800V. At this moment, the photoconductor was illuminated by a tungsten lamp of 5 lux, so that the exposure $E_{\frac{1}{2}}$ (lux·sec) required for reducing the surface potential to +400V by the light exposure was measured.

Each of the above photoconductors was exposed to the light of 100,000 lux sec by use of a tungsten lamp with a color temperature of 2856° K. and was then subjected to the same charging and exposing process as mentioned above, so that the corresponding surface potential V' (V) and exposure $E'_{\frac{1}{2}}$ (lux·sec) of the photoconductor was measured. The results are shown in Table 9.

TABLE 9

| | Charging Polarity | Before Fatigue $V_2$ (V) | Before Fatigue $E_{\frac{1}{2}}$ (lux · sec) | After Fatigue $V_2'$ (V) | After Fatigue $E'_{\frac{1}{2}}$ (lux · sec) |
|---|---|---|---|---|---|
| Example 9-1 | − | −703 | 0.79 | −674 | 0.78 |
| Comp. Ex. 9-1 | − | −657 | 0.78 | −450 | 0.75 |
| Example 9-2 | − | −696 | 0.77 | −672 | 0.77 |
| Comp. Ex. 9-2 | − | −624 | 0.77 | −436 | 0.73 |
| Example 9-3 | − | −912 | 0.50 | −878 | 0.49 |
| Comp. Ex. 9-3 | − | −875 | 0.48 | −509 | 0.46 |
| Example 9-4 | − | −883 | 0.51 | −795 | 0.48 |
| Comp. Ex. 9.4 | − | −810 | 0.49 | −152 | (*1) |
| Example 9-5 | + | +961 | 0.52 | +908 | 0.52 |
| Comp. Ex. 9-5 | + | +928 | 0.51 | +535 | 0.49 |
| Example 9-6 | + | +674 | 0.86 | +613 | 0.83 |
| Comp. Ex. 9-6 | + | +646 | 0.86 | +147 | (*2) |

(*1): Unable to charge the photoconductor to a surface potential of −800 V even after negative charge application for 15 seconds.
(*2): Unable to charge the photoconductor to a surface potential of +800 V even after positive charge application for 15 seconds.

What is claimed is:

1. An electrophotographic photoconductor comprising an electroconductive support and a photoconductive layer comprising (i) a charge generation layer and (ii) a charge transport layer formed on the support, wherein said charge generation layer comprises a charge generating material and one component selected from the group consisting of an aliphatic alcohol and a crown ether, or said charge transport layer comprises a charge transporting material and one component selected from the group consisting of an aliphatic alcohol, a polyalkylene glycol, a polyalkylene glycol ester, a polyalkylene glycol ether, and a crown ether.

2. An electrophotographic photoconductor comprising an electroconductive support and a photoconductive layer comprising (i) a charge generation layer and (ii) a charge transport layer formed on the support, wherein said charge generation layer comprises a charge generating material and one component selected from the group consisting of an aliphatic alcohol and a crown ether.

3. An electrophotographic photoconductor comprising an electroconductive support and a photoconductive layer comprising (i) a charge generation layer and (ii) a charge transport layer formed on the support, wherein said charge transport layer comprises a charge transporting material and one component selected from the group consisting of an aliphatic alcohol, a polyalkylene glycol, a polyalkylene glycol ester, a polyalkylene glycol ether, and a crown ether.

4. An electrophotographic photoconductor comprising an electroconductive support and a photoconductive layer comprising (i) a charge generation layer and (ii) a charge transport layer formed on the support, wherein said charge generation layer comprises a charge generating material and an aliphatic alcohol.

5. An electrophotographic photoconductor comprising an electroconductive support and a photoconductive layer comprising (i) a charge generation layer and (ii) a charge transport layer formed on the support, wherein said charge generation comprises a charge generating material and a crown ether.

6. The electrophotographic photoconductor as claimed in claim 4, wherein said aliphatic alcohol in said charge generation layer is selected from the group consisting of a monohydric aliphatic alcohol having 5 or more carbon atoms, and a dihydric aliphatic alcohol having 2 or more carbon atoms.

7. The electrophotographic photoconductor as claimed in claim 6, wherein said monohydric aliphatic alcohol is selected from the group consisting of n-amyl alcohol, isoamyl alcohol, 2-methyl-1-butanol, n-hexyl alcohol, n-heptyl alcohol, pentamethyl ethyl alcohol, n-octyl alcohol, n-nonylalcohol, lauryl alcohol, myristyl alcohol, ceptyl alcohol, stearyl alcohol, n-eicosyl alcohol, n-docosanol, ceryl alcohol, n-octacosyl alcohol, n-triacontyl alcohol, and melissyl alcohol.

8. The electrophotographic photoconductor as claimed in claim 6, wherein said monohydric aliphatic alcohol is selected from the group consisting of lauryl alcohol, myristyl alcohol, ceptyl alcohol, stearyl alcohol, n-eicosyl alcohol, n-docosanol, and ceryl alcohol.

9. The electrophotographic photoconductor as claimed in claim 6, wherein said dihydric aliphatic alcohol is selected from the group consisting of ethylene glycol, propylene glycol, ethylethylene glycol, 2,3-butanediol, 2-methyl-1,2-propanediol, 1,2-pentanediol, 2,3-pentanediol, threo-2,3-pentanediol, erythro-2,3-pentanediol, 3-methyl-1,2-butanediol, 2-methyl-1,2-butanediol, 2-methyl-2,3-butanediol, pinacol, trimethylene glycol, 1,3-butanediol, 2,4-pentanediol, 2-methyl-2,4-butanediol, 2-methyl-2,4-pentanediol, 2,4-dimethyl-2,4-pentanediol, hexamethyl trimethylene glycol, 2,2-dimethyl trimethylene glycol, 2,2-dimethyl-1,3-bubanediol, 2,2-dimethyl-1,3-pentanediol, tetramethylene glycol, 2,2,4-trimethyl-1,3-pentanediol, γ-pentylene glycol, 2-methyl-2,5-pentanediol, 3-methyl-2,5-pentanediol, 1,4-hexanediol, 2,5-hexanediol, 2,5-dimethyl-2,5-hexanediol, pentamethylene glycol, 1,5-hexanediol, hexamethylene glycol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,12-octadecanediol, and 1,18-octadecanediol.

10. The electrophotographic photoconductor as claimed in claim 5, wherein said crown ether is selected from the group consisting of:

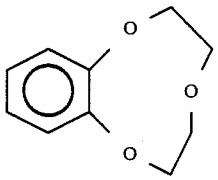
Benzo-9-crown-3-ether
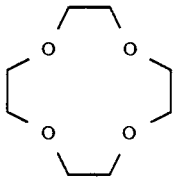
12-crown-4-ether
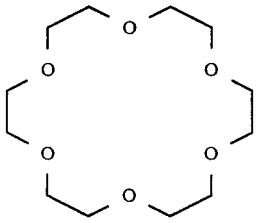
18-crown-6-ether
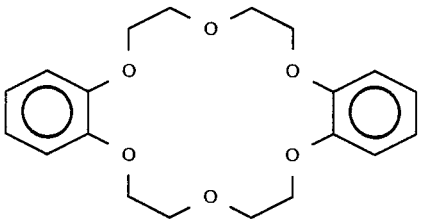
Dibenzo-18-crown-6-ether
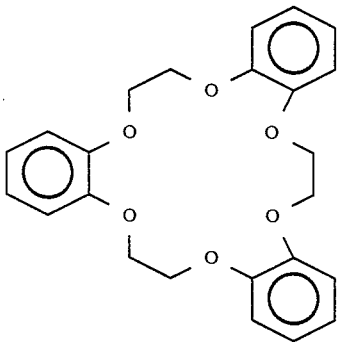
Tribenzo-18-crown-6-ether
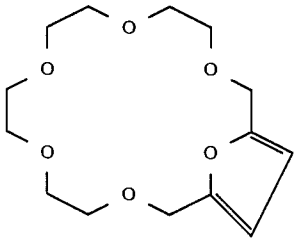
-continued
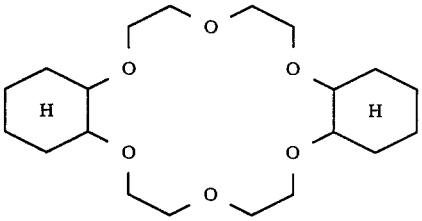
Perhydrobenzo-18-crown-6-ether
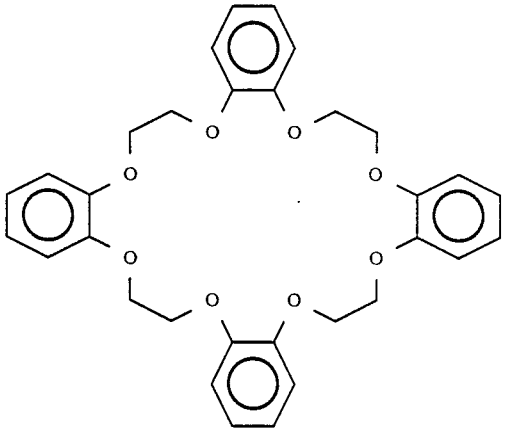
Tetrabenzo-24-crown-8-ether
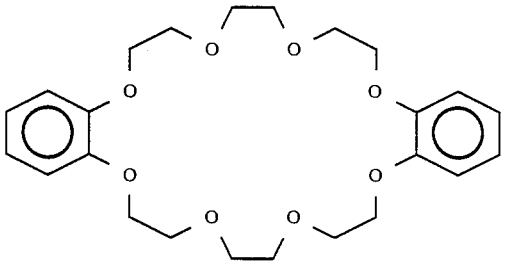
Dibenzo-24-crown-8-ether
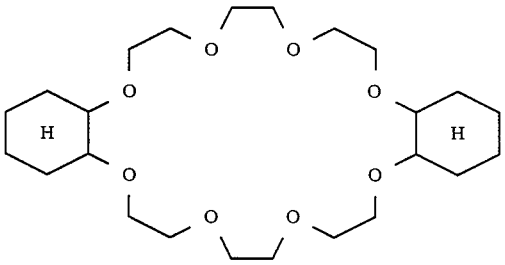
Dicyclohexano-24-crown-8-ether
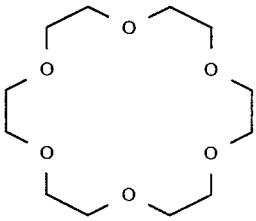
18-crown-6-ether -continued

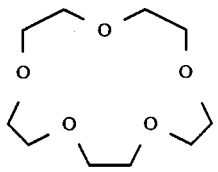

15-crown-5-ether

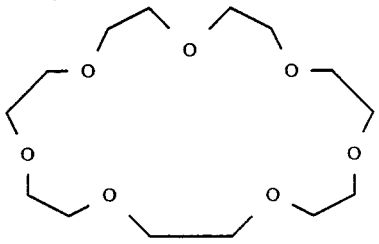

21-crown-7-ether

11. An electrophotographic photoconductor comprising an electroconductive support and a photoconductive layer comprising (i) a charge generation layer and (ii) a charge transport layer formed on the support, wherein said charge transport layer comprises a charge transporting material and an aliphatic alcohol.

12. The electrophotographic photoconductor as claimed in claim 11, wherein said aliphatic alcohol is selected from the group consisting of a monohydric aliphatic alcohol having 10 or more carbon atoms and a dihydric aliphatic alcohol having 5 or more carbon atoms.

13. The electrophotographic photoconductor as claimed in claim 12, wherein said monohydric aliphatic alcohol is selected from the group consisting of n-decyl alcohol, n-undecyl alcohol, dodecyl alcohol, n-tridecyl alcohol, n-tetradecyl alcohol, pentadecyl alcohol, hexadecyl alcohol, n-heptadecyl alcohol, octadecyl alcohol, 1-eicosanol and 1-docosanol.

14. The electrophotographic photoconductor as claimed in claim 12, wherein said dihydric aliphatic alcohol is selected from the group consisting of 2,2-dimethyl-1,3-propanediol, 2-ethyl-1,3-propanediol, 1,5-pentanediol, 2,4-pentanediol, 1,6-hexanediol, 2,5-hexanediol, 2-methyl-2,4-pentanediol, 2-propyl-1,3-propanediol, 2-butyl-1,3-propanediol, 1,8-octanediol, 2-pentyl-1,3-propanediol, 2-ethyl-1,3-hexanediol, 2,2,4-trimethyl-1,3-pentanediol, 1,10-decanediol, and 1,12-dodecanediol.

15. An electrophotographic photoconductor comprising an electroconductive support and a photoconductive layer comprising (i) a charge generation layer and (ii) a charge transport layer formed on the support, wherein said charge transport layer comprises a charge transporting material and a polyalkylene glycol.

16. The electrophotographic photoconductor as claimed in claim 15, wherein said polyalkylene glycol is selected from the group consisting of polyethylene glycol, polypropylene glycol, polyethylene glycol and a random copolymer and a block copolymer of hydroxyethylene and hydroxypropylene.

17. An electrophotographic photoconductor comprising an electroconductive support and a photoconductive layer comprising (i) a charge generation layer and (ii) a charge transport layer formed on the support, wherein said charge transport layer comprises a charge transporting material and a polyalkylene glycol ester.

18. The electrophotographic photoconductor as claimed in claim 17, wherein said polyalkylene glycol ester is selected from the group consisting of polyethylene glycol monocarboxylic acid ester, polyethylene glycol dicarboxylic acid ester, and a carboxylic acid ester of polyoxysorbitan.

19. An electrophotographic photoconductor comprising an electroconductive support and a photoconductive layer comprising (i) a charge generation layer and (ii) a charge transport layer formed on the support, wherein said charge transport layer comprises a charge transporting material and a polyalkylene glycol ether.

20. The electrophotographic photoconductor as claimed in claim 19, wherein said polyalkylene glycol ether is selected from the group consisting of a polyethylene glycol monoether, polypropylene glycol monoether and a monoether of a copolymer of hydroxyethylene and hydroxypropylene.

21. The electophotographic photoconductor as claimed in claim 20, wherein said polyethylene glycol monoether has the formula:

$$R—O—CH_2Ch_2)_nH$$

wherein R represents an alkyl group having 1 to 30 carbon atoms, or a phenyl group having as a substituent an alkyl group having 1 to 20 carbon atoms; and n is an integer of 2 to 1,000.

22. The electrophotographic photoconductor as claimed in claim 20, wherein said propylene glycol monoether had the formula:

$$R—O-(C_3H_6O)_nH$$

Wherein R represents an alkyl group having 1 to 30 carbon atoms, or a phenyl group having as a substituent an alkyl group having 1 to 20 carbon atoms; and n is an integer or 5 to 100.

23. An electrophotographic photoconductor comprising an electroconductive support and a photoconductive layer comprising (i) a charge generation layer and (ii) a charge transport layer formed on the support, wherein said charge transport layer comprises a charge transporting material and a crown ether.

24. The electrophotographic photoconductor as claimed in claim 23, wherein said crown ether is selected from the group consisting of benzo-9-crown-3-ether, 12-crown-4-ether, 18-crown-6-ether, dibenzo-18-crown-6-ether, tribenzo-18-crown-6-ether, dibenzo-24-crown-8-ether, dicyclohexano-24-crown-8-ether, dicyclohexano-18-crown-6-ether, tetrabenzo-24-crown-8-ether, 18-crown-6-ether, 15-crown-5-ether, 21-crown-7-ether, poly(dibenzo-18-crown-6-ether) having the following formula,

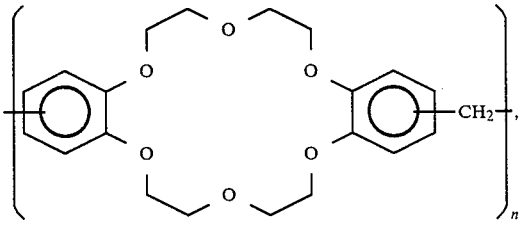

-continued
and

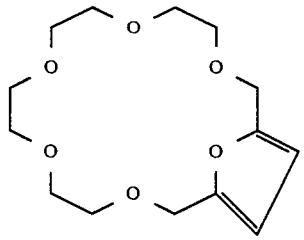

25. The electophotographic photoconductor as claimed in claim 4, wherein the amount of said aliphatic alcohol is at least 0.01 part by weight to 100 parts by weight of said charge generating material.

26. The electrophotographic photoconductor as claimed in claim 5, wherein the amount of said crown ether is at least 0.01 part by weight to 100 parts by weight of said charge generating material.

27. The electrophotographic photoconductor as claimed in claim 11, further comprising a binder resin, and the amount of said aliphatic alcohol is in the range of 0.1 to 20 parts by weight to 100 parts by weight of the total of said charge transporting material and said binder agent.

28. The electrophotographic photoconductor as claimed in claim 15, further comprising a binder resin, and the amount of said polyalkylene glycol is in the range of 0.1 to 10 parts by weight to 100 parts by weight of the total of said charge transporting material and said binder agent.

29. The electrophotographic photoconductor as claimed in claim 17, further comprising a binder resin, and the amount of said polyalkylene glycol ester is in the range of 0.1 to 10 parts by weight to 100 parts by weight of the total of said charge transporting material and said binder agent.

30. The electrophotographic photoconductor as claimed in claim 19, further comprising a binder resin, and the amount of said polyalkylene glycol ether is in the range of 0.1 to 10 parts by weight to 100 parts by weight of the total of said charge transporting material and said binder agent.

31. The electrophotographic photoconductor as claimed in claim 23, further comprising a binder resin, and the amount of said crown ether is in the range of 0.1 to 20 parts by weight to 100 parts by weight of the total of said charge transporting material and said binder agent.

* * * * *